US007878826B2

(12) United States Patent
Kikuchi

(10) Patent No.: US 7,878,826 B2
(45) Date of Patent: Feb. 1, 2011

(54) CARD CONNECTOR

(75) Inventor: Kouji Kikuchi, Tokyo (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 12/497,912

(22) Filed: Jul. 6, 2009

(65) Prior Publication Data

US 2010/0022136 A1 Jan. 28, 2010

(30) Foreign Application Priority Data

Jul. 23, 2008 (JP) ..... 2008-189713
Nov. 18, 2008 (JP) ..... 2008-294365

(51) Int. Cl.
*H01R 13/62* (2006.01)

(52) U.S. Cl. ..... 439/159; 439/946

(58) Field of Classification Search ..... 439/153, 439/155, 159, 945, 946
See application file for complete search history.

(56) References Cited

U.S. PATENT DOCUMENTS 3,980,167 A 9/1976 Tamura et al.
4,404,464 A 9/1983 Moreno
4,421,372 A 12/1983 Golden
4,722,693 A 2/1988 Rose
5,035,633 A 7/1991 Kobayashi et al.
5,179,504 A 1/1993 Kitahara
5,207,598 A 5/1993 Yamada et al.
5,300,763 A 4/1994 Ito et al.
5,490,791 A 2/1996 Yamada et al.
5,563,397 A 10/1996 Fujimoto et al.
5,876,218 A 3/1999 Liebenow et al.
6,056,573 A 5/2000 Nishioka
6,068,365 A 5/2000 Nagoshi et al.

(Continued)

FOREIGN PATENT DOCUMENTS

CN 2520582 Y 11/2002

(Continued)

OTHER PUBLICATIONS

International search Report Application No. PCT/JP00/007762, dated Feb. 6, 2001 from the European Patent Office.

(Continued)

*Primary Examiner*—James Harvey
(74) *Attorney, Agent, or Firm*—Finnegan, Henderson, Farabow, Garrett & Dunner, LLP

(57) ABSTRACT

There is provided a card connector having a metallic ejection member. A card connector, in which a card accommodating space is formed by a base member and a cover member, comprises a plurality of contacts arranged on the base member, an ejection member capable of moving relative to the base member in a longitudinal direction, a compression coil spring biasing the ejection member rearward, and a heart cam mechanism including a heart cam and a cam groove. The ejection member includes a card push portion, a body, on a forward portion of which a coil spring accommodating space is formed, on a rear portion of which a swinging space is formed, and a coupling portion. The ejection member is formed integrally from a metallic sheet. The coil spring accommodating space and the swinging space are arranged in a row on the same line in a longitudinal direction.

7 Claims, 17 Drawing Sheets

U.S. PATENT DOCUMENTS

| | | | | |
|---|---|---|---|---|
| 6,068,500 | A | 5/2000 | Kantner | |
| 6,109,940 | A | 8/2000 | Chad et al. | |
| 6,123,557 | A | 9/2000 | Wang et al. | |
| 6,129,572 | A | 10/2000 | Feldman et al. | |
| 6,135,809 | A | 10/2000 | Asakawa | |
| 6,186,401 | B1 | 2/2001 | Magana | |
| 6,203,378 | B1 | 3/2001 | Shobara et al. | |
| 6,231,360 | B1 * | 5/2001 | Horie | 439/159 |
| 6,345,760 | B1 | 2/2002 | Eason et al. | |
| 6,361,369 | B1 | 3/2002 | Kondo et al. | |
| 6,386,920 | B1 | 5/2002 | Sun | |
| 6,399,906 | B1 | 6/2002 | Sato et al. | |
| 6,402,529 | B2 | 6/2002 | Saito et al. | |
| 6,413,108 | B2 | 7/2002 | Centefonte | |
| 6,457,647 | B1 | 10/2002 | Kurihashi et al. | |
| 6,468,101 | B2 | 10/2002 | Suzuki | |
| 6,482,029 | B2 | 11/2002 | Nishimura | |
| 6,503,092 | B1 | 1/2003 | Sato | |
| 6,508,402 | B1 | 1/2003 | Takada et al. | |
| 6,511,350 | B1 | 1/2003 | Ito et al. | |
| 6,524,137 | B1 | 2/2003 | Liu et al. | |
| 6,527,590 | B2 | 3/2003 | Oguchi | |
| 6,547,601 | B2 | 4/2003 | Oguchi | |
| 6,601,766 | B2 | 8/2003 | Nakagawa et al. | |
| 6,607,404 | B1 | 8/2003 | Ito et al. | |
| 6,612,492 | B1 | 9/2003 | Yen | |
| 6,641,413 | B2 | 11/2003 | Kuroda | |
| 6,655,973 | B2 * | 12/2003 | Ji et al. | 439/159 |
| 6,666,724 | B1 | 12/2003 | Lwee | |
| 6,699,053 | B2 | 3/2004 | Kuroda | |
| 6,700,788 | B2 | 3/2004 | Matsushita et al. | |
| 6,716,066 | B1 | 4/2004 | Kuo | |
| 6,780,062 | B2 | 8/2004 | Liu et al. | |
| 6,783,399 | B2 | 8/2004 | Joung | |
| 6,913,492 | B2 | 7/2005 | Kuroda et al. | |
| 7,052,325 | B2 | 5/2006 | Lin et al. | |
| 7,118,397 | B1 * | 10/2006 | Su et al. | 439/159 |
| 7,381,069 | B2 | 6/2008 | Saito et al. | |
| 7,661,971 | B1 * | 2/2010 | Abe | 439/159 |
| 2003/0157839 | A1 | 8/2003 | Yamaguchi et al. | |
| 2004/0026507 | A1 | 2/2004 | Nagata et al. | |
| 2004/0106326 | A1 | 6/2004 | Hsieh | |
| 2004/0110423 | A1 | 6/2004 | Shishikura et al. | |
| 2006/0057892 | A1 | 3/2006 | Bricaud et al. | |
| 2010/0022136 | A1 * | 1/2010 | Kikuchi | 439/630 |

FOREIGN PATENT DOCUMENTS

| | | | |
|---|---|---|---|
| DE | 1033491 | | 7/1958 |
| DE | 3 937 383 | A1 | 6/1990 |
| DE | 4 139 482 | | 6/1993 |
| EP | 0 284 431 | A2 | 9/1988 |
| EP | 0 696 008 | | 2/1996 |
| EP | 1 487 001 | | 9/1997 |
| EP | 0 936 705 | A2 | 8/1999 |
| EP | 0 939 582 | A2 | 9/1999 |
| EP | 1 146 474 | | 10/2001 |
| EP | 1 246 312 | A2 | 10/2002 |
| EP | 1 324 256 | | 7/2003 |
| JP | 60-133071 | | 9/1985 |
| JP | 63-133473 | | 6/1988 |
| JP | 03-46969 | | 4/1991 |
| JP | 06-139415 | | 5/1994 |
| JP | 07-192102 | | 7/1995 |
| JP | 07-335321 | | 12/1995 |
| JP | 08-55661 | | 2/1996 |
| JP | 10-21348 | | 1/1998 |
| JP | 10-091729 | | 4/1998 |
| JP | 2784346 | | 5/1998 |
| JP | 10-187896 | | 7/1998 |
| JP | 10-289754 | | 10/1998 |
| JP | 11-135192 | | 5/1999 |
| JP | 11-316110 | | 11/1999 |
| JP | 2000-40562 | | 2/2000 |
| JP | 2000-277200 | | 6/2000 |
| JP | 2000-251024 | | 9/2000 |
| JP | 2000-251025 | | 9/2000 |
| JP | 2000-260524 | | 9/2000 |
| JP | 2000-277207 | | 10/2000 |
| JP | 2001-135385 | | 5/2001 |
| JP | 2001-143789 | | 5/2001 |
| JP | 2001-143815 | | 5/2001 |
| JP | 2001-195546 | | 7/2001 |
| JP | 2001-237027 | | 8/2001 |
| JP | 2001-267013 | | 9/2001 |
| JP | 2001-291552 | | 10/2001 |
| JP | 2002-050434 | | 2/2002 |
| JP | 2002-157056 | | 5/2002 |
| JP | 2002-164124 | | 6/2002 |
| JP | 2002-174532 | | 6/2002 |
| JP | 2002-270261 | | 9/2002 |
| JP | 2002-289280 | | 10/2002 |
| JP | 2002-289295 | | 10/2002 |
| JP | 2002-289299 | | 10/2002 |
| JP | 2002-343498 | | 11/2002 |
| JP | 2002-367720 | | 12/2002 |
| JP | 3396457 | B2 | 2/2003 |
| JP | 2003-288962 | | 10/2003 |
| JP | 2003-317858 | | 11/2003 |
| JP | 2004-071257 | | 3/2004 |
| JP | 2004-95234 | | 3/2004 |
| JP | 2004-193111 | | 7/2004 |
| JP | 2004-214119 | | 7/2004 |
| JP | 2004-311123 | | 11/2004 |
| JP | 2005-011666 | | 1/2005 |
| JP | 2005-044780 | | 2/2005 |
| JP | 2005-135696 | | 5/2005 |
| JP | 2005-519452 | | 6/2005 |
| JP | 2005-520296 | | 7/2005 |
| JP | 2005-222437 | | 8/2005 |
| JP | 2005-222537 | | 8/2005 |
| JP | 2005-242946 | | 9/2005 |
| JP | 2005-243434 | | 9/2005 |
| JP | 2005-285522 | | 10/2005 |
| JP | 2005-322498 | | 11/2005 |
| JP | 2006-108118 | | 4/2006 |
| JP | 2006-520073 | | 8/2006 |
| JP | 2007-026854 | | 2/2007 |
| JP | 2007-080580 | | 3/2007 |
| JP | 3132340 | | 5/2007 |
| JP | 2007-157356 | | 6/2007 |
| JP | 2007-323945 | | 12/2007 |

OTHER PUBLICATIONS

Japanese Search Report for Japanese Patent Application 2002-257115.

Office Action dated Feb. 19, 2008 in Japanese Patent Application No. 2004-016394.

Office Action dated Jul. 18, 2008 in Japanese Application No. 2005-106769.

Office Action dated Jun. 6, 2008 in Chinese Patent Application No. 200610067036.7.

Official Action dated Apr. 30, 2008 from German Patent Office for German Patent Application No. 10354208.6-34.

Official Action from Japanese Patent Office for Application No. 2003-385753, mailed Jun. 14, 2005.

Official Letter for Japanese Patent Application No. 2004-058232, issued Apr. 19, 2007.

* cited by examiner

CARD CONNECTOR

CROSS-REFERENCE TO RELATED APPLICATIONS

This application claims the benefit of Japanese Patent Application Nos. 2008-189713 filed Jul. 23, 2008, and Nos. 2008-294365 filed Nov. 18, 2008 which are hereby incorporated by reference herein in their entirety.

BACKGROUND OF THE INVENTION

1. Field of the Invention

The present invention relates to a card connector for coupling portion of a card (referred simply below to as "IC card"), in which an integrated circuit is built, to a circuit board of an electronic equipment or the like, and more particular, to a card connector comprising an ejection mechanism that assists in inserting and withdrawing an IC card.

2. Description of the Related Art

A push-push type ejection mechanism constructed to enable readily and surely inserting and withdrawing an IC card is well known in the prior art as disclosed in, for example, Japanese Patent Laid-Open No. 2000-251024.

With the card connector disclosed in Japanese Patent Laid-Open No. 2000-251024, a card accommodating space is formed by a base member formed from an insulating, synthetic resin, and a cover member formed from a metal or a synthetic resin. Also, the push-push type ejection mechanism substantially comprises an ejection member formed from a synthetic resin, a compression coil spring, a heart cam mechanism, and a swinging arm. The ejection member abuts against an IC card and moves together with the IC card along a side wall of the base member in the card accommodating space of the card connector. The ejection member is biased by the compression coil spring arranged on the base member in a direction in which the IC card is withdrawn. The heart cam mechanism is formed on the base member and one end of the swinging arm is guided in a cam groove of the heart cam mechanism. In addition, the other end of the swinging arm is held by the ejection member to be able to swing.

Further, in order to prevent the IC card from jumping out of the card connector when the IC card is withdrawn, a feeling lock member attached to the ejection member is conventionally proposed.

As disclosed in Japanese Patent Laid-Open No. 2000-251024 or the like, there is a limitation on material strength in the case where the ejection member is formed from a synthetic resin, and so there is a need of increasing the ejection member in thickness and width with the result that it is made difficult to make a card connector small in size and thickness. Also, the swinging arm and the feeling lock member are fabricated as separate members from the ejection member and attached to the ejection member whereby an increase in the number of parts and manufacturing processes is brought about. Further, since the ejection member is structured to move along the side wall of the base member made from a synthetic resin, there is a fear that the side wall is abrades and damaged when an IC card is repeatedly inserted and withdrawn.

It is an object of the invention to solve such problem and to provide a card connector having a metallic ejection member, which is simple in structure and easy to manufacture.

SUMMARY OF THE INVENTION

In order to attain the object, the invention has a feature in a card connector, in which a card accommodating space capable of accommodating at least a part of a card with an integrated circuit built therein in an insertable and drawable manner is formed by assembling a base member formed from an insulating, synthetic resin and having at least a bottom wall and a forward wall and a cover member formed from a metallic sheet and having at least a roof plate and left and right side walls, the card connector comprising a plurality of contacts arranged on the base member and connected electrically to the card, an ejection member capable of moving in a longitudinal direction, in which the card is inserted and withdrawn, relative to the base member as the card is inserted and withdrawn, and having a swinging arm capable of elastic deformation in a right and left direction, a compression coil spring that biases the ejection member rearward when the card is mounted in the card accommodating space, and a heart cam mechanism including a heart cam formed on the base member and a cam groove formed to extend around the heart cam and from the heart cam and permitting movement therein of a lock pin provided at a tip end of the swinging arm, and wherein the ejection member includes a card push portion, against which a tip end of the card abuts, a body, on a forward portion of which a coil spring accommodating space accommodating therein the compression coil spring is formed, on a rear portion of which a swinging space enabling the swinging arm to swing right and left therein is formed, and which is inverted U-shaped in vertical section, and a coupling portion, which couples between the card push portion and the forward portion of the body and is U-shaped in vertical section, the ejection member including the card push portion, the body, and the coupling portion is formed integrally from a metallic sheet, and the coil spring accommodating space and the swinging space are arranged in a row on the same line in a longitudinal direction.

Also, the card connector according to the invention has a feature in that the ejection member further includes a feeling lock member capable of elastic deformation in a right and left direction, and the feeling lock member is provided in a position opposed to the swinging arm within the swinging space and a supporting point of the feeling lock member and a supporting point of the swinging arm are diagonally positioned within the swinging space.

Further, the card connector according to the invention has a feature in that the body, which constitutes the ejection member, includes a horizontal, upper wall, an outer wall, and an inner wall and is inverted U-shaped in vertical section, and the coupling portion, which constitutes the ejection member, includes a horizontal, lower wall, a outer wall, and a inner wall and is U-shaped in vertical section, the outer wall of the coupling portion constituting a part of the inner wall of the body.

Also, with the card connector according to the invention, preferably, the swinging arm is formed from a part of the outer wall of the body, which constitutes the ejection member, and formed to swing right and left in the swinging space, and the feeling lock member is formed from a part of the inner wall of the body, which constitutes the ejection member, and formed to swing right and left between the card accommodating space and the swinging space.

Further, with the card connector according to the invention, the horizontal, upper wall of the body, which constitutes the ejection member, preferably moves in a longitudinal direction to contact with the roof plate of the cover member.

Since the ejection member of the card connector according to the invention having at least the swinging arm is formed integrally from a metallic sheet, parts are decreased in number and the coil spring accommodating space and the swinging space are arranged on the same line longitudinally of the ejection member, whereby the ejection member can be made small in size and hence the card connector can be made small in size.

Since the ejection member has the feeling lock member, parts are further decreased in number and since the swinging arm and the feeling lock member are arranged in opposition to each other to position respective supporting points diagonally, the swinging space can be made small in size and hence the card connector can be made small in size.

The card connector can be further made small in size and the compression coil spring as accommodated can be prevented from flexing by making the body of the ejection member inverted U-shaped to ensure the stiffness for the body of the ejection member and making use of a space, which is formed, for the coil spring accommodating space and the swinging space. Thereby, it is possible to prevent the ejection member from inclining toward the card accommodating space.

The swinging space can be further surely made small in size by making use of parts of the opposed outer wall and inner wall of the body, which constitutes the ejection member, to form the swinging arm and the feeling lock member.

The horizontal, upper wall of the body, which constitutes the ejection member, is moved to contact with the roof plate of the cover member whereby the ejection member can move smoothly in a longitudinal direction without abrasion in contact with the side wall of the base member when a card is mounted and dismounted.

Further features of the present invention will become apparent from the following description of exemplary embodiments (with reference to the attached drawings).

DESCRIPTION OF THE EMBODIMENTS

First Embodiment

Figure 1:
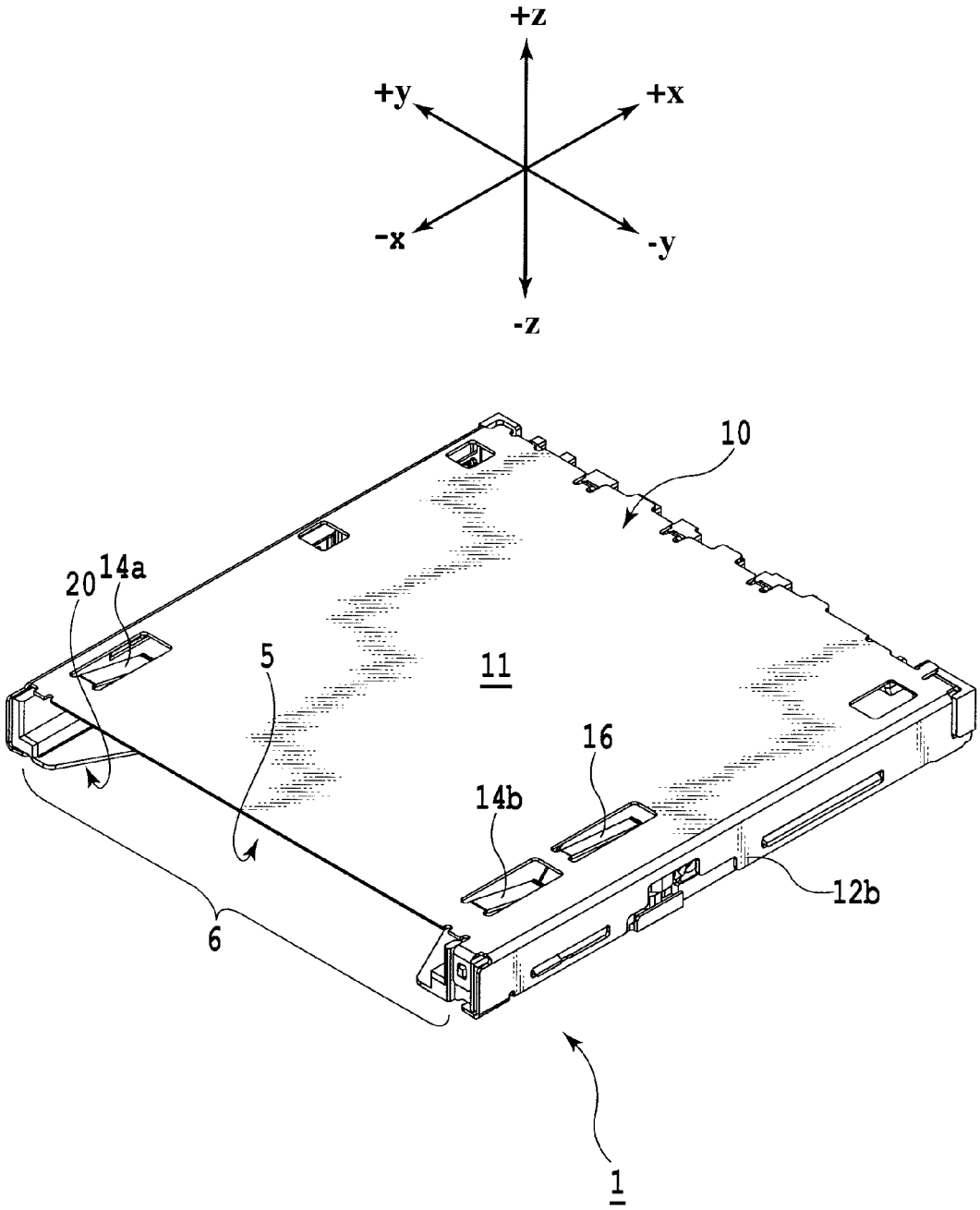
FIG. 1 is a perspective view showing a card connector, according to the invention, as viewed from rightwardly, obliquely rearwardly and above.
Figure 2:
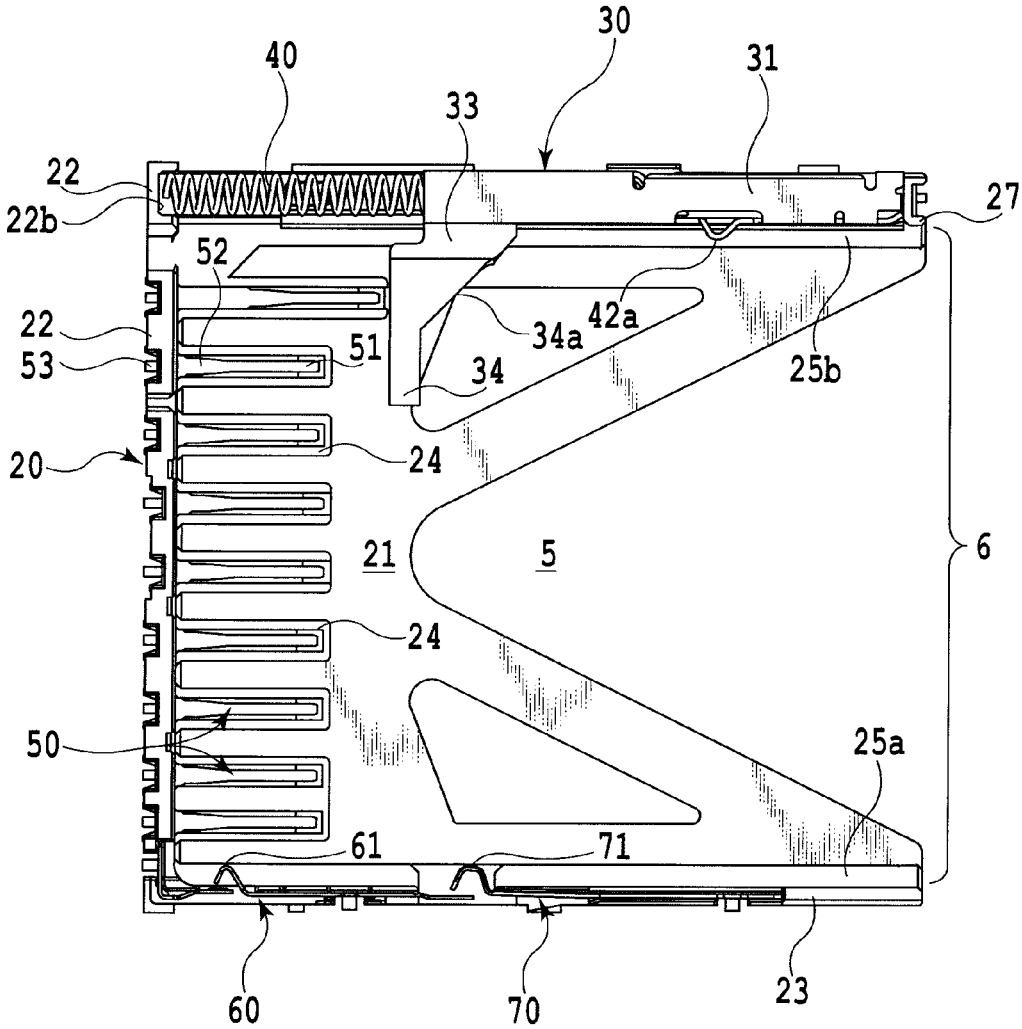
FIG. 2 is a top plan view showing the card connector with a cover member removed.
Figure 3:
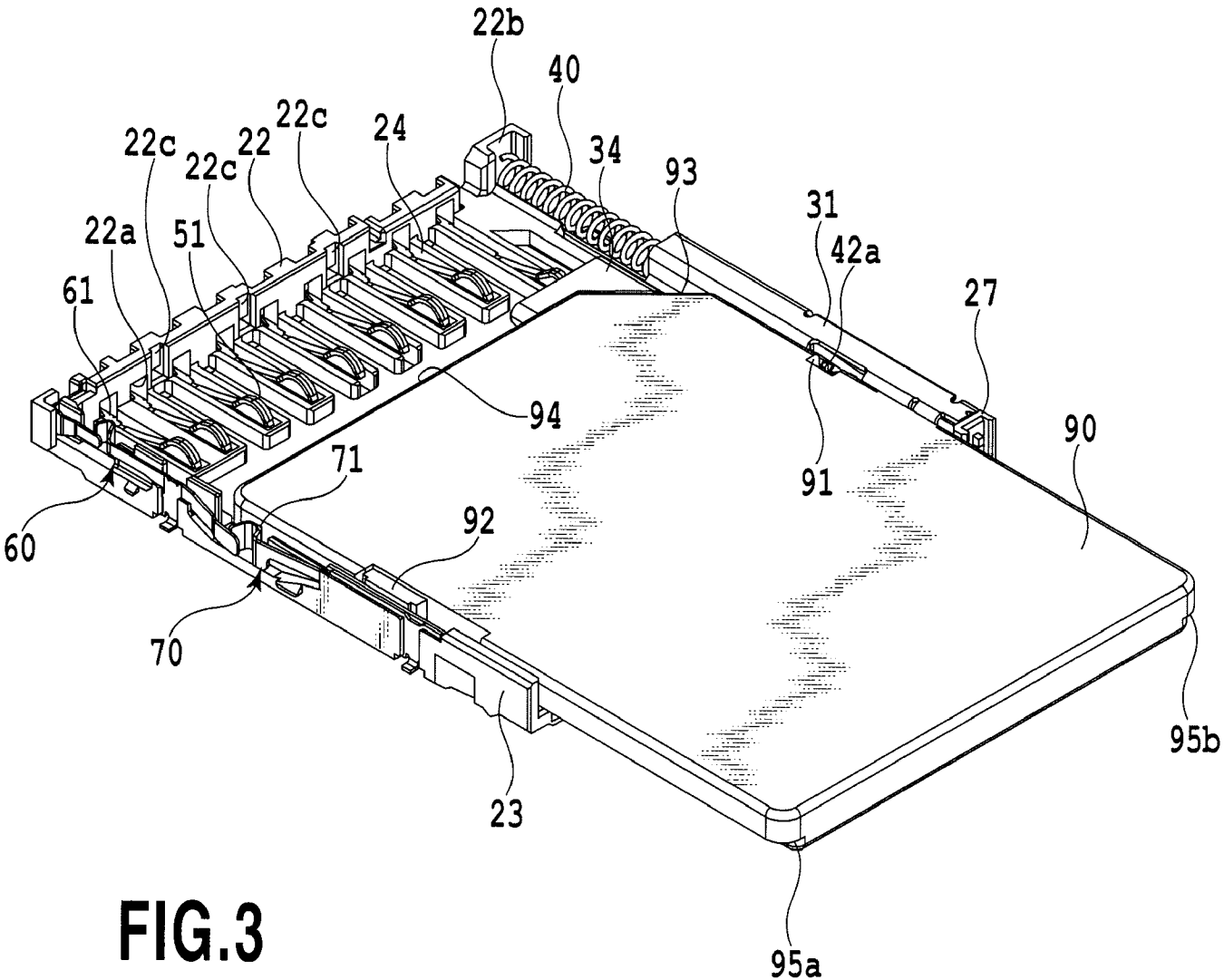
FIG. 3 is a perspective view showing a state of a card in the course of being inserted into a card accommodating space of the card connector, shown in FIG. 2, with the cover member removed.
Figure 4:
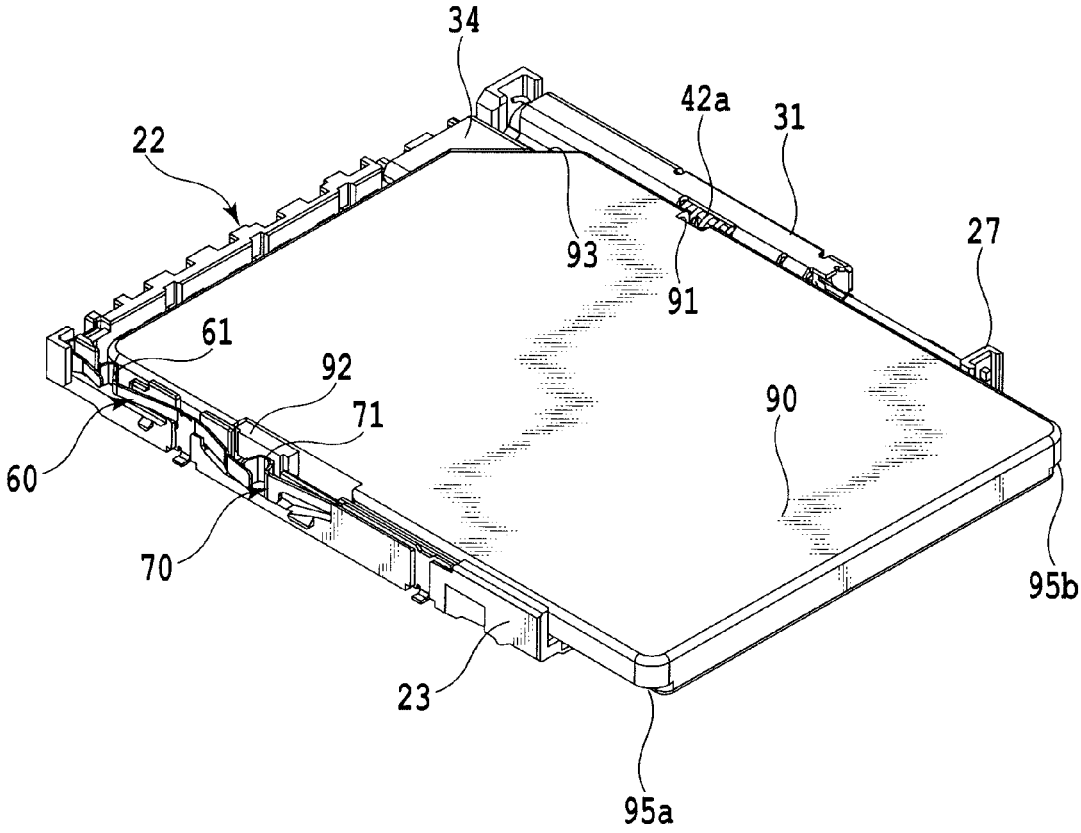
FIG. 4 is a perspective view showing a state, in which a card has been fully inserted into the card accommodating space of the card connector shown in FIG. 2.
Figure 5:
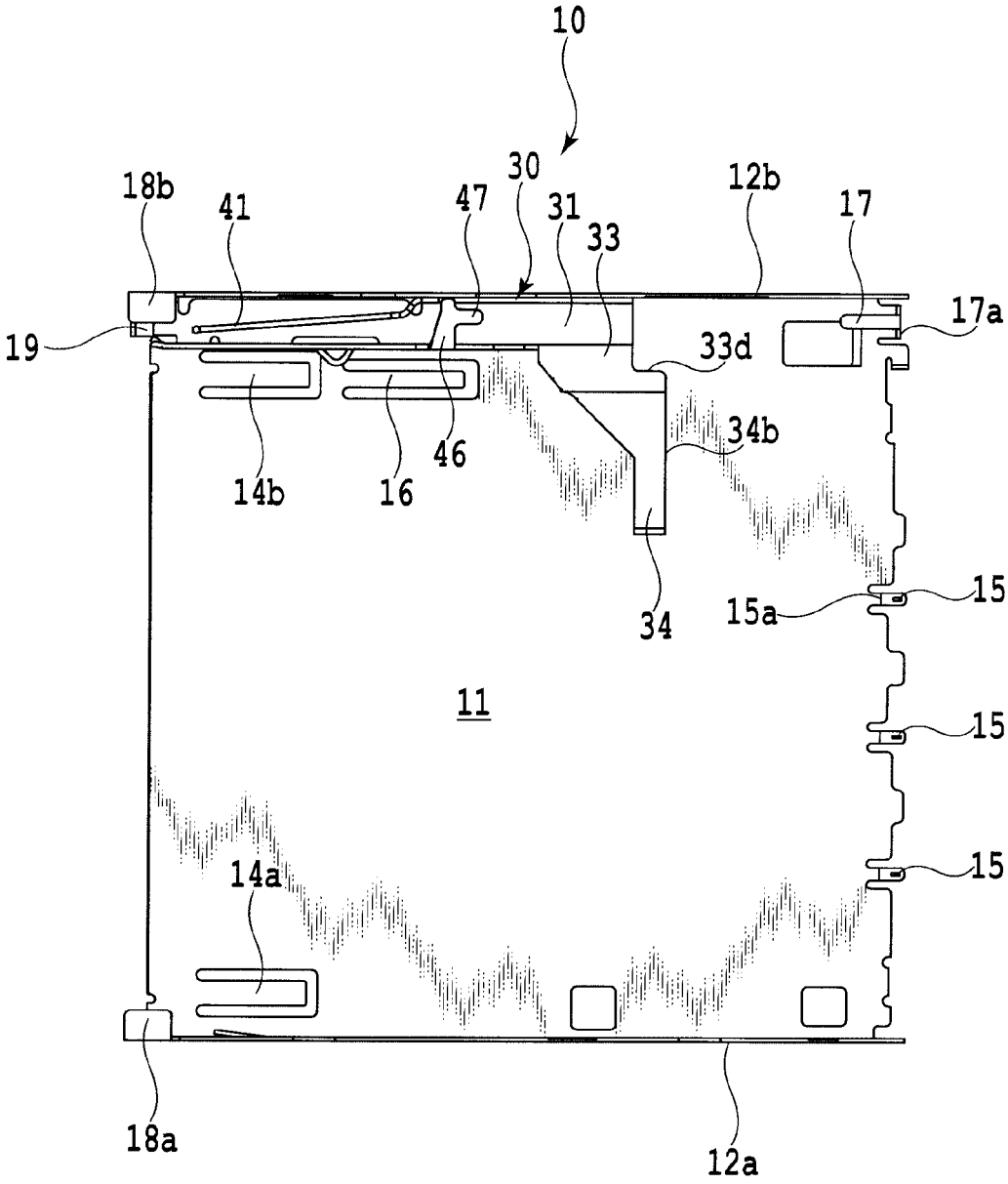
FIG. 5 is a bottom view showing the cover member, into which an ejection member is assembled.
Figure 6:
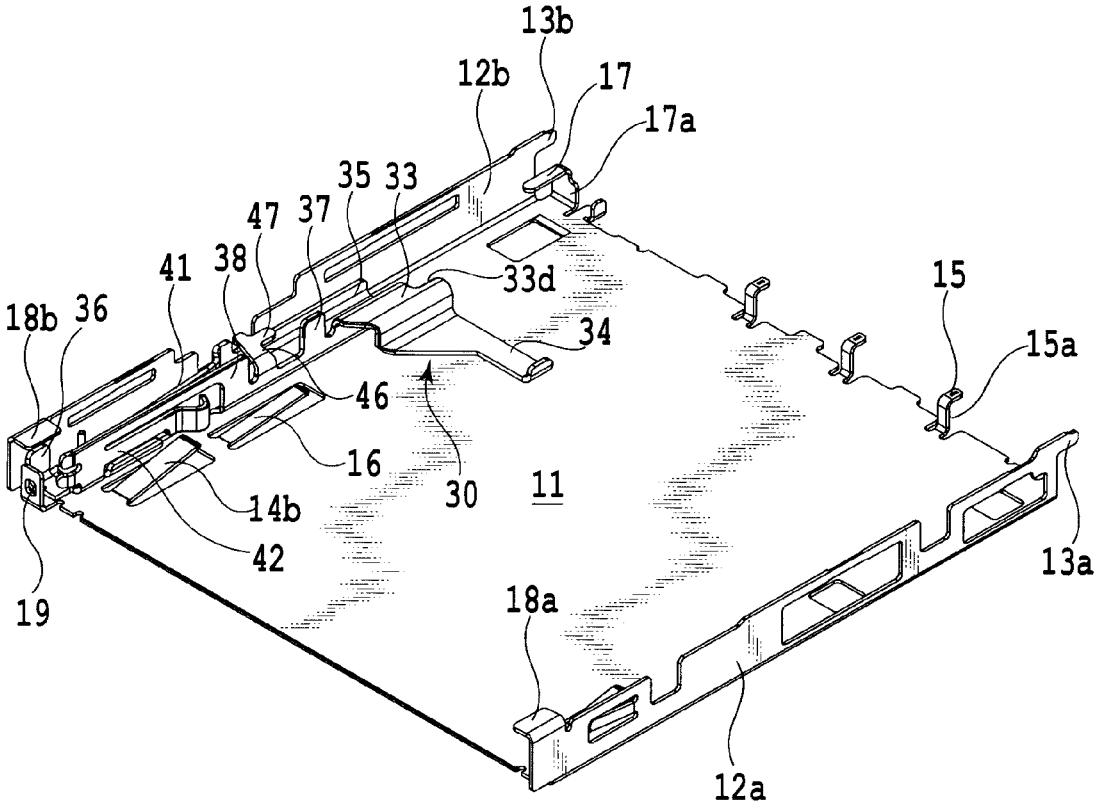
FIG. 6 is a perspective view showing the cover member of FIG. 5 as viewed from leftwardly, obliquely rearwardly and underneath.
Figure 7A:
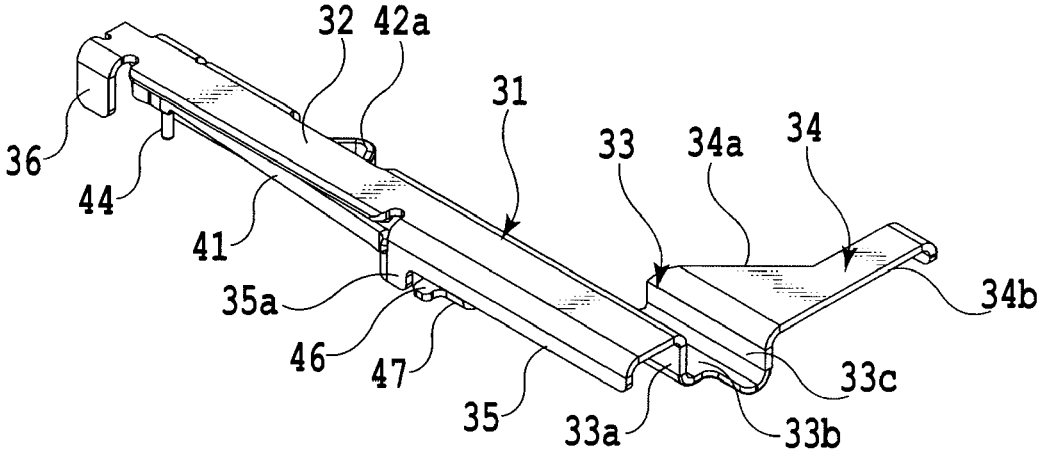
FIG. 7A is a view showing the ejection member of the card connector according to the invention and a perspective view showing the ejection member as viewed from leftwardly, obliquely forwardly and above.
Figure 7B:
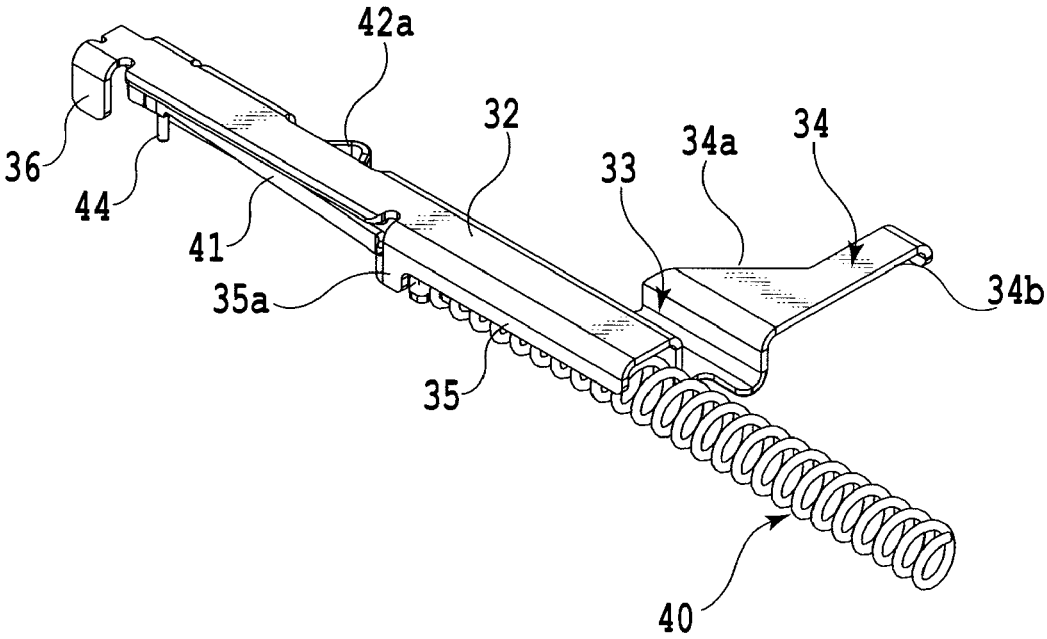
FIG. 7B is a view showing the ejection member of the card connector according to the invention and a view showing a state, in which a compression coil spring is assembled into the ejection member of FIG. 7A.
Figure 8A:
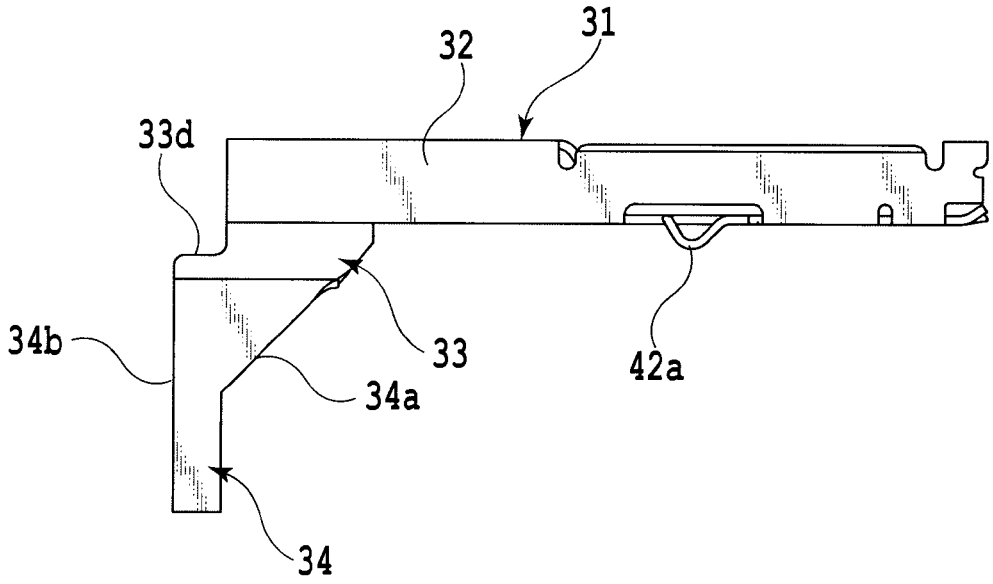
FIG. 8A is a view showing the ejection member of the card connector according to the invention and a plan view showing the ejection member shown in FIG. 7A.
Figure 8B:
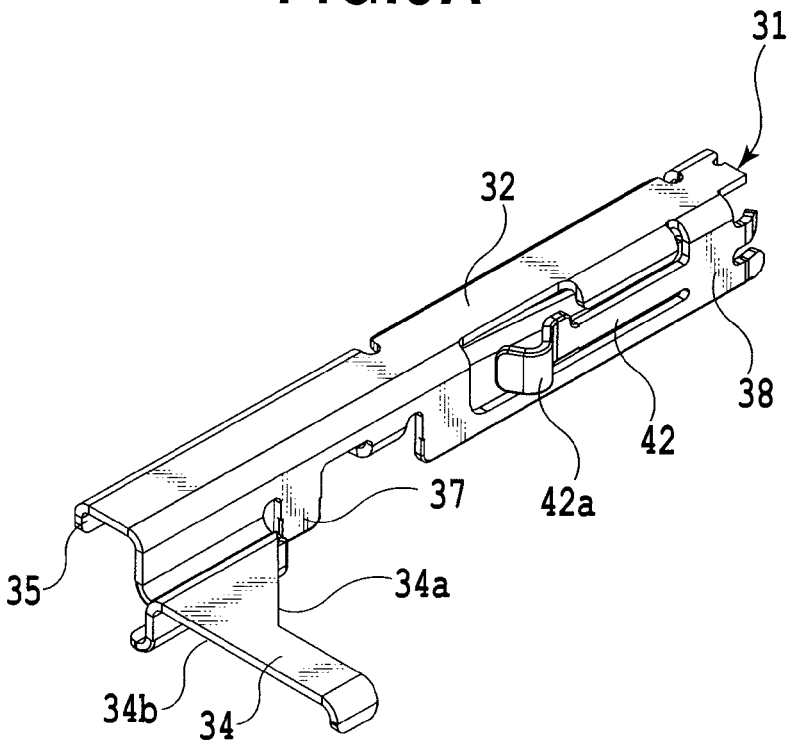
FIG. 8B is a view showing the ejection member of the card connector according to the invention and a perspective view showing the ejection member shown in FIG. 7A, as viewed at a different angle.
Figure 9A:
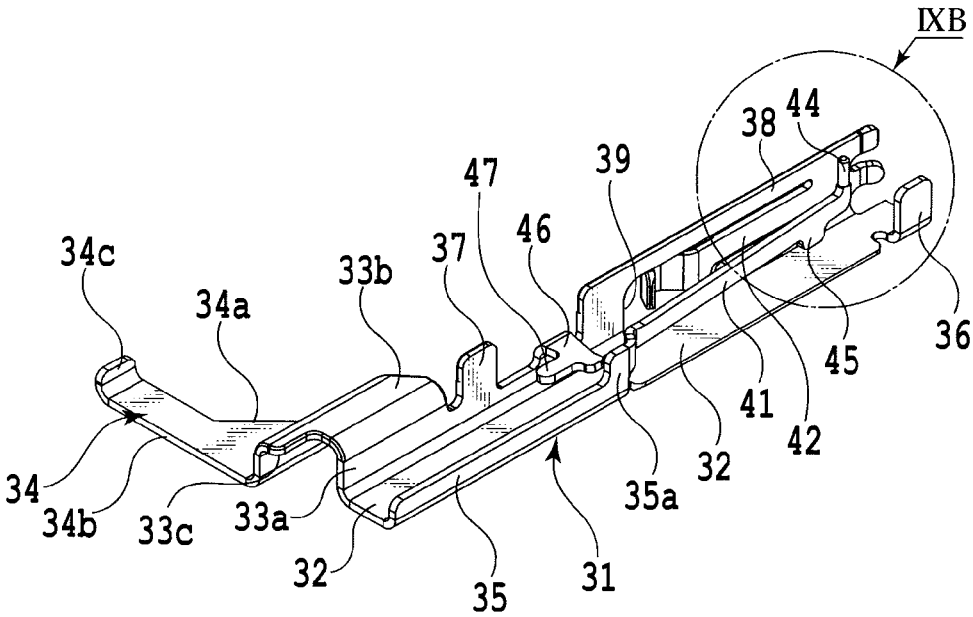
FIG. 9A is a view showing the ejection member of the card connector according to the invention and a perspective view showing the ejection member as viewed from rightwardly, obliquely forwardly and underneath.
Figure 9B:
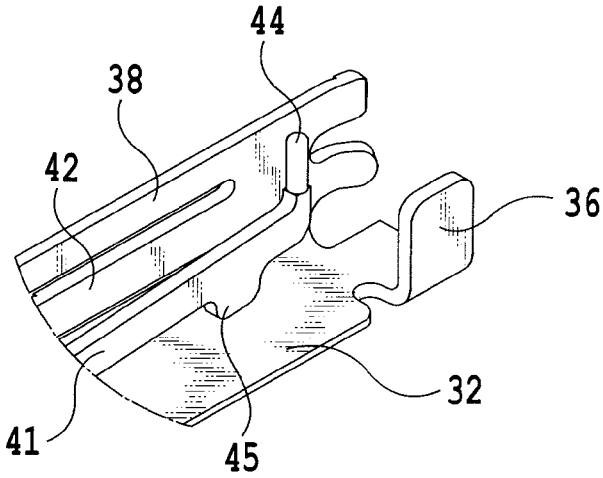
FIG. 9B is a view showing the ejection member of the card connector according to the invention and a partially enlarged view showing the ejection member shown in FIG. 9A.
Figure 10:
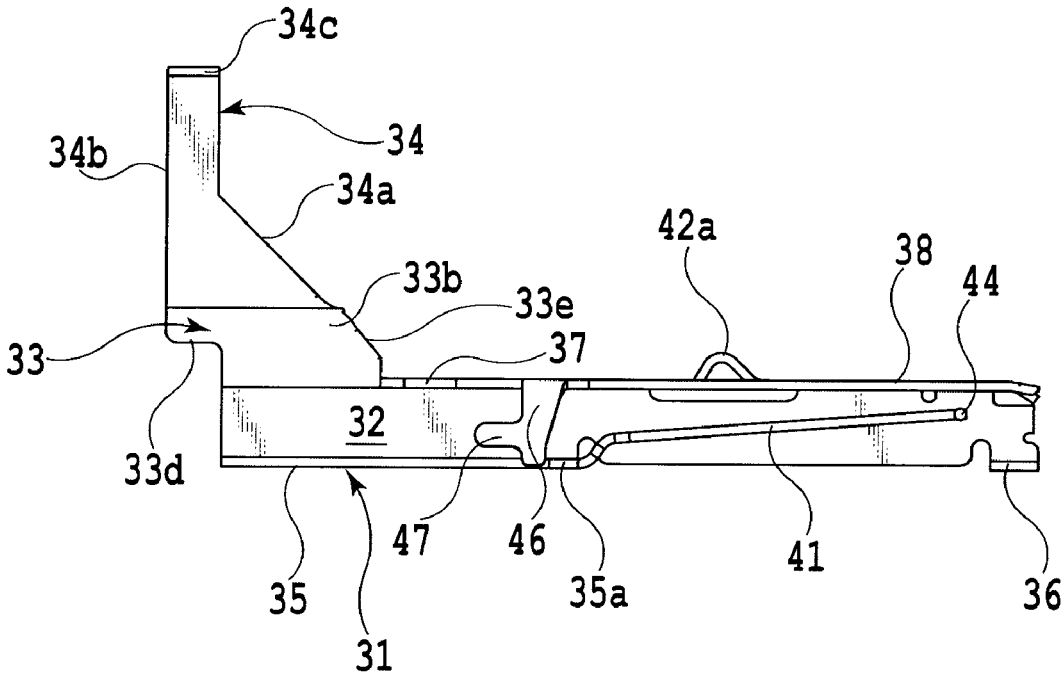
FIG. 10 is a bottom view showing the ejection member shown in FIG. 7A.
Figure 11:
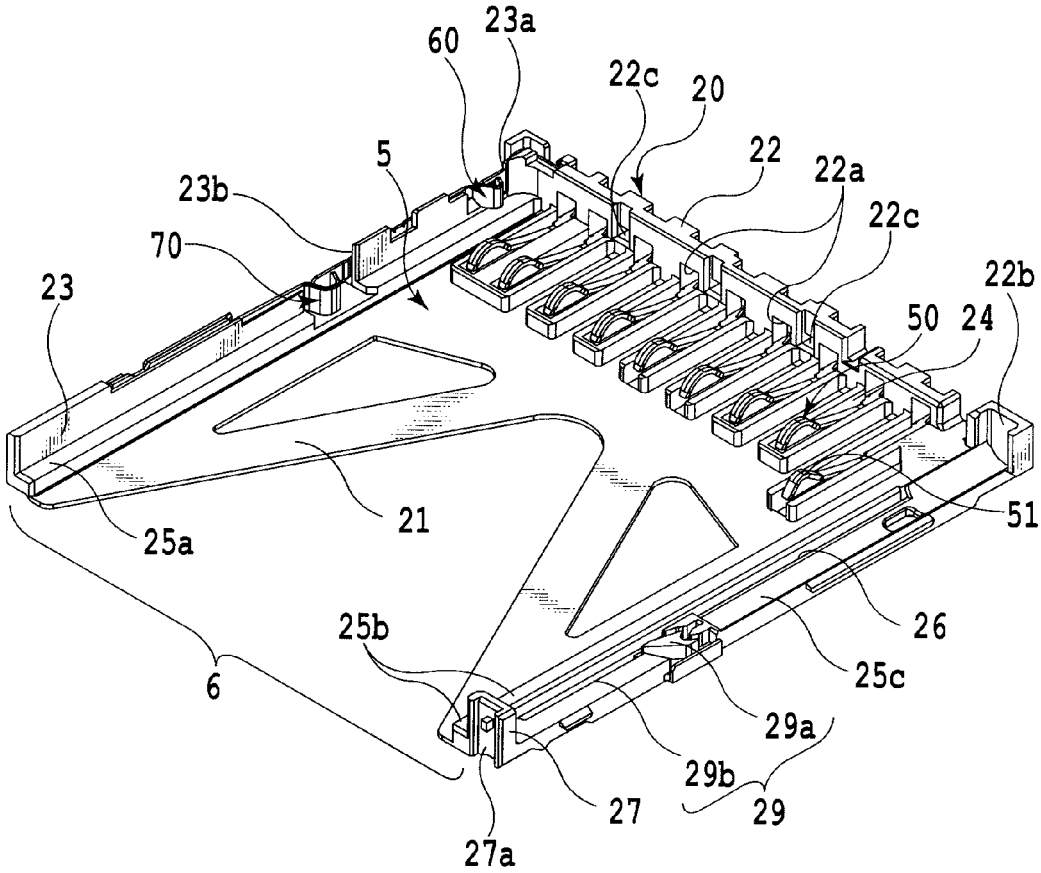
FIG. 11 is a perspective view showing a base member, on which a plurality of contacts are arranged, as viewed from rightwardly, obliquely rearwardly and above.

A first embodiment of the invention will be described below with reference to FIGS. 1 to 11. FIG. 1 is a perspective view showing a card connector, according to the invention, as viewed from rightwardly, obliquely rearwardly and above. FIG. 2 is a plan view showing the card connector with a cover member removed. FIG. 3 is a perspective view showing a state of a card in the course of being inserted into a card accommodating space of the card connector, shown in FIG. 2, with the cover member removed. FIG. 4 is a view showing a state, in which a card is inserted into the card accommodating space of the card connector shown in FIG. 2, and a perspective view showing a state, in which a card has been fully inserted into the card accommodating space. FIG. 5 is a bottom view showing the cover member, into which an ejection member is assembled. FIG. 6 is a perspective view showing the cover member of FIG. 5 as viewed from leftwardly, obliquely rearwardly and underneath. FIGS. 7 to 10 are detailed views showing the ejection member of the card connector according to the invention, FIG. 7A being a perspective view showing the ejection member as viewed from leftwardly, obliquely forwardly and above, and FIG. 7B being a perspective view showing a state, in which a compression coil spring is assembled into the ejection member of FIG. 7A. FIG. 8A is a plan view showing the ejection member of FIG. 7A and FIG. 8B is a perspective view showing the ejection member of FIG. 7A as viewed at a different angle. FIG. 9A is a perspective view showing the ejection member as viewed from rightwardly, obliquely forwardly and downwardly thereof and FIG. 9B is a partially enlarged view showing the ejection member shown in FIG. 9A. FIG. 10 is a bottom view showing the ejection member of FIG. 7A. FIG. 11 is a perspective view showing a base member, on which a plurality of contacts are arranged, as viewed from rightwardly, obliquely rearwardly and above.

In addition, in the descriptions of the specification of the present application, the terms "front" and "rear" or the equivalent terms thereof, respectively, indicate +x side and −x side in the coordinate shown in FIG. 1, the terms "left" and "right" or the equivalent terms thereof, respectively, indicate +y side and −y side shown in FIG. 1, and the terms "up" and "down" or the equivalent terms thereof, respectively, indicate +z side and −z side.

As shown in FIGS. 1 and 2, a card connector 1 substantially comprises a cover member 10, a base member 20, an ejection member 30, and a plurality of contacts 50.

The cover member 10 is formed from a metallic sheet by means of press working and overlaps with the base member 20, described later, vertically to be assembled, thereby defining a card accommodating space 5, in which at least a part of an IC card 90 is accommodated. The IC card 90 is inserted forward from a card insertion port 6 formed rearwardly of the card accommodating space 5. In the embodiment, the IC card 90 mounted in the card connector 1 is a known SD (Super density or Secure Digital) card and has a construction, in which a pair of steps 95*a*, 95*b* are formed on the right and left and a lower side of the card is a little small in width (length in a right and left direction) as compared with an upper side thereof. Also, a contact pad being an external contact of the IC card 90 is arranged in a recess formed on an underside of the card. In addition, the IC card 90 mounted in the card connector 1 according to the invention is not limitative.

As shown in detail in FIGS. 5 and 6, the cover member 10 includes a rectangular-shaped roof plate 11, which forms an upper wall of the card accommodating space 5, a left wall 12*a* and a right wall 12*b*, which are formed on the left and right of the roof plate 11. The both left and right walls 12*a*, 12*b* form a right angle to the roof plate 11 and are in parallel to each other. In the embodiment, the ejection member 30, described later, constituting a push-push type ejection mechanism for mounting and ejecting the IC card 90 moves in a longitudinal direction (in other words, a direction, in which the IC card 90 is inserted and withdrawn) along the roof plate 11 and the right wall 12*b* of the cover member 10. In the embodiment, while the ejection member 30 is structured to move along the right wall 12*b*, it is possible to adopt a construction, in which the ejection member moves along the left wall 12*a*, according to the structure of an IC card inserted. Forward soldering pieces 13*a*, 13*b*, respectively, are provided at forward ends of the left and right walls 12*a*, 12*b* to extend from the left and right walls 12*a*, 12*b* and formed in opposition to each other. Also, rear soldering pieces 18*a*, 18*b*, respectively, are provided at rear ends of the left and right walls 12*a*, 12*b* to be bent from the left and right walls 12*a*, 12*b* to be opposed to each other. After the card connector 1 is assembled, the left and right, forward soldering pieces 13*a*, 13*b* and the left and right, rear soldering pieces 18*a*, 18*b* are soldered to an electronic equipment whereby the card connector 1 is fixed to the electronic equipment.

A first coil spring support piece 17 supporting one end of a coil spring 40 is bent at a forward end of the roof plate 11 and in the vicinity of the right wall 12*b* from the roof plate 11. As shown in FIG. 6, the first coil spring support piece 17 is formed to be bent inward (rearward) at a right angle to a bent piece 17*a* bent at a right angle from the roof plate 11. Accordingly, the first coil spring support piece 17 is formed substantially in parallel to the roof plate 11. Also, the bent piece 17*a* is formed to abut against an inner wall surface (rear wall surface) of a front wall 22 of the base member 20 described later. Also, a suitable number (three in the embodiment) of fixation pieces 15 are bent at the forward end of the roof plate 11 to be at a right angle to the roof plate 11. As shown in FIG. 6, the respective fixation pieces 15 are formed to be bent outward (forward) at a right angle to bent pieces 15*a* bent at a right angle from the roof plate 11. Also, the bent pieces 15*a* engage with holes 22*c* (see FIG. 3), which are formed on the inner wall surface (rear wall surface) of the front wall 22 of the base member 20 described later. The fixation pieces 15 are used to position the cover member 10 relative to the base member 20 and to fix the same to the base member 20.

Also, a reinforcement piece 19 is bent at a right angle from the roof plate 11 at a rear end of the roof plate 11 and in the vicinity of the right wall 12*b*. In the embodiment, the reinforcement piece 19 is formed to come into surface contact with an outer surface (rear surface) side of an abutment wall 27 of the base member 20, against which a rear end of the ejection member 30 abuts, when assembled, thereby reinforcing the abutment wall 27. In addition, the reinforcement piece 19 may be provided in surface contact with an inner surface (forward surface) side of the abutment wall 27 so as to have the rear end of the ejection member 30 abutting directly thereagainst.

Further, a pair of left and right braking pieces 14*a*, 14*b* for prevention of an IC card mounted from coming off is formed on both sides of a rear portion of the roof plate 11 by means of press working. The braking pieces 14*a*, 14*b*, respectively, are free at forward ends and bent inward (downward) at a predetermined angle of inclination from the roof plate 11 so that the free ends contact elastically with the IC card 90.

Also, in the embodiment, a ground terminal piece 16 for grounding of the IC card 90 through the cover member 10 is formed in front of the right braking piece 14*b* by means of press working. The ground terminal piece 16 is provided in association with the IC card 90 inserted and not necessarily needed. Like the right braking piece 14*b*, the ground terminal piece 16 is free at a forward end and bent inward (downward) at a predetermined angle of inclination from the roof plate 11 so that the free end can contact elastically with a ground terminal (not shown) of the IC card 90.

Subsequently, the base member 20 is formed from an insulating, synthetic resin to be substantially shaped like a box and overlaps the cover member 10 vertically to be assembled, thereby defining the card accommodating space 5, in which the IC card 90 is mounted.

As shown in detail in FIGS. 2 and 11, the base member 20 includes a bottom wall 21, the front wall 22, a left wall 23, a pair of left and right guide rails 25*a*, 25*b*, a guide bottom wall 25*c*, and contact accommodating grooves 24. The bottom wall 21 defines a lower wall of the card accommodating space 5, the front wall 22 is formed upright at a forward end of the bottom wall 21, and the left wall 23 is formed upright at a left end of the bottom wall 21. The left wall 23 is formed also at a right angle to the front wall 22.

In the embodiment, a right wall opposed to the left wall 23 is omitted. That is, in the embodiment, unlike conventional card connectors, the ejection member 30 does not move along a side wall of the base member 20 but moves along the right wall 12*b* of the cover member 10 longitudinally as described above. In the embodiment, the right wall is omitted, so that a width (left and right length) can be decreased corresponding to at least the thickness of the right wall as compared with conventional card connectors.

The plurality of contact accommodating grooves 24, in which a plurality of contacts are accommodated one by one, are formed forwardly of the bottom wall 21. The plurality of contact accommodating grooves 24 extend inwardly (rearwardly) of the front wall 22, at a right angle to the front wall 22, and longitudinally in parallel to each other. Each of the contact accommodating grooves 24 is surrounded by walls including the front wall 22 on four peripheries and is in the form of an elongated rectangle as viewed from above. A through-hole 22*a* penetrating through the front wall 22 in a longitudinal direction is formed forwardly of the contact accommodating groove 24, the contact 50 extends through the through-hole 22*a* to have a fixation portion 52 press-fitted and fixed therein, and a terminal 53 thereof projects forward. In order to increase contact portions 51 of the contacts 50, which are accommodated in the respective contact accommodating grooves 24, in deformation, through-holes penetrating vertically through the bottom wall 21 may be formed in positions corresponding to the contact portions 51 rearwardly of the contact accommodating grooves 24.

Formed at a right end of the front wall 22 is an accommodating groove 22*b* opened upward and rearward (inward) so that an outer surface (front surface) of the bent piece 17*a* of the first coil spring support piece 17 described above comes into surface contact with the inner wall surface of the front wall 22 and the bent piece 17*a* is fitted thereinto.

The left guide rail 25*a* and the right guide rail 25*b* are formed on both left and right sides of the bottom wall 21 to be made stepwise and symmetrically located on the bottom wall 21. The left and right guide rails 25*a*, 25*b* are formed following the stepwise configuration of the IC card 90 inserted to guide the IC card 90, which is inserted into the card accommodating space 5 from the card insertion port 6, in a correct posture. The left guide rail 25*a* is disposed inwardly (rightwardly) of the left wall 23 at an intersection of the left wall 23 and the bottom wall 21 to extend longitudinally to the front wall 22 from the card insertion port 6. The right guide rail 25*b* is disposed inwardly (leftwardly) of the guide bottom wall 25*c* described later, in parallel to the left guide rail 25*a*, and in opposition to the left guide rail 25*a* to extend longitudinally to the front wall 22 from the card insertion port 6.

The guide bottom wall 25*c* extends longitudinally to be further rightwardly of the right guide rail 25*b*, in parallel to the right guide rail 25*b*, and substantially flush with an upper surface of the right guide rail 25*b*. A rail groove 26 extending longitudinally is formed between the guide bottom wall 25*c* and the right guide rail 25*b*. First and second inner walls 37, 38, described later, of the ejection member 30 are loosely fitted into the rail groove 26 and the first and second inner walls 37, 38 are guided by the rail groove 26, whereby the ejection member 30 can surely move on the guide bottom wall 25*c* in a longitudinal direction.

A heart cam mechanism 29 constituting a push-push type ejection mechanism is provided on a rearward, upper surface of the guide bottom wall 25*c*. As conventionally known, the heart cam mechanism 29 comprises a heart cam 29*a*, and a cam groove 29*b* formed to extend around and longitudinally (in the embodiment, rearwardly) of the heart cam 29*a* (see Japanese Patent Laid-Open No. 2000-251024 for further details). A lock pin 44 provided at a tip end of a swinging arm 41, described later, of the ejection member 30 moves in the cam groove 29*b*, which constitutes the heart cam mechanism 29.

The abutment wall 27 is also formed at a rear end of the guide bottom wall 25*c*, and the reinforcement piece 19 of the cover member 10 is arranged on a rear surface side of the abutment wall 27 as described above. The ejection member 30 is caused by the action of the coil spring 40 to abut against the abutment wall 27 when the IC card 90 is not inserted into the card connector 1. The rear surface side of the abutment wall 27 is preferably formed with a mount groove 27*a*, which is opened vertically and rearwardly to permit the reinforcement piece 19 to be exactly fitted thereinto.

Further, according to the embodiment, as shown in FIGS. 2 and 11, a card recognition switch 60 is provided forward along the left wall 23 of the base member 20 to detect whether the IC card 90 is fully mounted into the card connector 1. Also, a write-protect switch 70 is provided rearwardly of the card recognition switch 60 to detect a position of a write-protect button 92 of the IC card 90 mounted. As shown in the figure, the card recognition switch 60 and the write-protect switch 70 are supported on an outer side surface of the left wall 23 in a cantilever-like manner. Also, respective contact portions 61, 71 extend toward an interior of the card accommodating space 5 from notches 23*a*, 23*b* formed on the left wall 23 and are arranged to be capable of elastic deformation outward (leftward) as the IC card 90 is inserted.

Subsequently, the ejection member 30 being characteristic of the invention will be described in detail with reference to FIGS. 7A, 7B, FIGS. 8A, 8B, FIGS. 9A, 9B, and FIG. 10. The ejection member 30 is a main member constituting a push-push type ejection mechanism and is formed from a metallic sheet by means of press working in the embodiment. The ejection member 30 is a member that moves in a longitudinal direction, that is, a direction, in which the IC card 90 is inserted and withdrawn, as the IC card 90 is inserted and withdrawn.

In the embodiment, the ejection member 30 comprises a body 31 being substantially inverted U-shaped as viewed from the front, a coupling portion 33 being substantially U-shaped as viewed from the front, and a card push portion 34. The body 31, the coupling portion 33, and the card push portion 34 are punched into a predetermined shape from a single, metallic sheet and formed by means of press working as described above.

The body 31 substantially includes a horizontal upper wall 32, a first outer wall 35 and a second outer wall 36, which serve as an outer wall (right wall), and the first inner wall 37 and the second inner wall 38, which serve as an inner wall (left wall), and is substantially inverted U-shaped as viewed from the front, or in vertical section. In other words, the body 31 is substantially in the form of a box formed by the horizontal, upper wall 32, the outer wall, and the inner wall and opened longitudinally and downwardly.

The horizontal upper wall 32 is substantially flat and extends a predetermined length in a longitudinal direction to contact with the roof plate 11 of the cover member 10 when assembled. A substantially forward half of the horizontal upper wall 32 cooperates with the first outer wall 35, a vertical, outer wall 33*a* of the coupling portion 33, and the first inner wall 37 to define a coil spring accommodating space that accommodates the coil spring 40. Also, a substantially rearward half of the horizontal upper wall 32 cooperates with the second outer wall 36 and the second inner wall 38 to define a swinging space of the swinging arm 41, described later. Accordingly, the coil spring accommodating space and the swinging space are arranged in a row (that is, on the same line in a longitudinal direction) in a longitudinal direction whereby it is possible to make the connector small in widthwise dimension.

The first outer wall 35 is bent from a right side of a forward portion of the horizontal, upper wall 32 to form a right angle to the horizontal upper wall 32. The first outer wall 35 extends to a position of a half of the length of the horizontal upper wall 32 from a front end of the horizontal upper wall 32. In the embodiment, a forward portion of the first outer wall 35 is formed to have a small, vertical length as compared with a rear end wall portion 35*a* thereof, but it is not limited thereto.

For example, the forward portion of the first outer wall 35 may extend the same length as that of the rear end wall portion 35*a* with a downwardly opened slit therebetween. In this case, a horizontal portion of a L-shaped bent piece 46 provided with a second coil spring supporting piece 47 described later is fitted into the slit, so that the horizontal portion of the L-shaped bent piece 46 is held. The second outer wall 36 is bent from a right side of a rearward portion of the horizontal upper wall 32 to form a right angle to the horizontal upper wall 32. The second outer wall 36 is positioned rearwardly of and on an extension of the first outer wall 35. In the embodiment, when assembled, the first outer wall 35 and the second outer wall 36 of the ejection member 30 contact with the right wall 12*b* of the cover member 10 to be movable in a longitudinal direction.

In the embodiment, the swinging arm 41 is formed between the first outer wall 35 and the second outer wall 36. The swinging arm 41 is worked using an outer wall portion, which exists between the first outer wall 35 and the second outer wall 36, and formed by bending a worked piece of the outer wall portion, which exists between the first outer wall 35 and the second outer wall 36, so as to incline toward the second inner wall 38 from a rear end of the rear end wall portion 35*a* of the first outer wall 35.

The swinging arm 41 is capable of elastic deformation with the rear end of the rear end wall portion 35*a* as a supporting point, so that the swinging arm 41 can swing in the swinging space. Also, the lock pin 44 is formed at the tip end (rear end) of the swinging arm 41 to project downward. Preferably, a lower end of the lock pin 44 is formed to be, for example, semi-spherical in shape and an outer periphery of its columnar portion is formed to be cylindrical-shaped. In this manner, by forming the lower end of the lock pin 44 to be semi-spherical in shape and forming the outer periphery of the columnar portion to be cylindrical-shaped, it is possible to prevent the lock pin 44 from injuring the cam groove 29*b*, which constitutes the heart cam mechanism 29 and in which the lock pin 44 moves. Further, a holding projection 45 is formed forwardly of a position, in which the lock pin 44 is provided, to project upwardly of the swinging arm 41 in a reverse direction to a direction, in which the lock pin 44 projects. Owing to the presence of the holding projection 45, when the lock pin 44 rises due to some reason, the holding projection 45 abuts against the upper wall 32 whereby the lock pin 44 is prevented from coming off the cam groove 29*b*, which constitutes the heart cam mechanism 29. As indicated by a second embodiment described later, the holding projection 45 may be formed to extend longitudinally along the swinging arm 41 (see FIG. 16). By forming the holding projection 45 in this manner, the swinging arm 41 is reinforced and deformation of the swinging arm 41 is prevented, so that the lock pin 44 is further inhibited from coming off the cam groove 29*b*.

In addition, according to the embodiment, it has been described that the swinging arm 41 is formed by bending to incline toward the second inner wall 38 from the rear end of the rear end wall portion 35*a* of the first outer wall 35, but it is not limitative. For example, the swinging arm 41 may be formed by bending to make a right angle to the rear end wall portion 35*a* toward the second inner wall 38 from the rear end of the rear end wall portion 35*a* and further bending at a right angle to become substantially parallel to the second inner wall 38 in the vicinity of the medium of the swinging space. In short, it suffices to form the swinging arm 41 so that the lock pin 44 provided at the rear end of the swinging arm 41 can swing left and right in the swinging space.

The first inner wall 37 is formed in a position rearwardly of the coupling portion 33 and opposed to the first outer wall 35. The first inner wall 37 is bent from the left side of the horizontal upper wall 32 to make a right angle to the horizontal upper wall 32.

The second inner wall 38 is bent from a left side of a rearward portion of the horizontal upper wall 32 to make a right angle to the upper wall 32. The second inner wall 38 is positioned rearwardly of and on an extension of the first inner wall 37. The second inner wall 38 extends to a position of approximately a half of the length of the horizontal upper wall 32 from a rearward end of the horizontal upper wall 32. Lower end portions of the first inner wall 37 and the second inner wall 38 are loosely fitted into the rail groove 26 formed between the right guide rail 25*b* and the guide bottom wall 25*c* of the base member 20 to be able to move longitudinally in the rail groove 26.

The second inner wall 38 is formed with a longitudinally elongated, rectangular-shaped window portion 39, and by using and working an inner wall portion existing in the window portion 39, a feeling lock member 42 is formed to extend longitudinally in the window portion 39 from a side of a rear end of the window portion 39. The feeling lock member 42 is supported on the second inner wall 38 on the side of the rear end of the window portion 39 in a cantilever-like manner. The feeling lock member 42 comprises an engagement projection 42*a* formed to project into the card accommodating space 5, and the engagement projection 42*a* engages with an engagement recess 91 of the IC card 90 when the IC card 90 abuts against the card push portion 34. The feeling lock member 42 is capable of elastic deformation with the rear end side of the window portion 39 as a supporting point. The feeling lock member 42 prevents the IC card 90 mounted from coming off and prevents the IC card 90 from vigorously jumping out of the card accommodating space when the IC card 90 is to be removed.

As shown in FIG. 10, the side of the rear end of the window portion 39 as a supporting point of elastic deformation of the feeling lock member 42 is disposed in a substantially diagonal position relative to the rear end of the rear end wall portion 35*a*, as a supporting point of elastic deformation of the swinging arm 41, with the swinging space of the swinging arm 41 therebetween. The supporting points are arranged diagonally in this manner whereby one elastic deformation does not interfere with the other elastic deformation and respective amount of elastic deformations can be taken sufficiently largely even when the swinging space is small in width (left and right length).

For example, it is assumed that the feeling lock member 42 is provided on the first outer wall 35 and the swinging arm 41 is provided on the second inner wall 38. In this case, in order to prevent interference between mutual elastic deformations, it is necessary to intersect the feeling lock member 42 and the swinging arm 41 to each other. This results that the swinging space is increased in thickness (vertical height), and is not preferable. In view of this, by providing the feeling lock member 42 and the swinging arm 41 in a manner as in the embodiment, it is possible to decrease the swinging space in thickness, thus enabling miniaturization of the connector.

In the embodiment, the second coil spring supporting piece 47 is provided between the first inner wall 37 and the second inner wall 38 to support the other end of the coil spring 40, which biases the ejection member 30 rearward. The second coil spring supporting piece 47 is formed to project forward, for example, horizontally from an intermediate portion of a forward end of the L-shaped bent piece 46. The L-shaped bent piece 46 includes a vertical portion and a horizontal portion, the vertical portion being bent downward from the left side of the horizontal upper wall 32 to make a right angle to the horizontal upper wall 32 and further bent from a lower end of the vertical portion into the coil spring accommodating space so that the horizontal portion is become parallel to the horizontal upper wall 32. A rear end of the horizontal portion of the L-shaped bent piece 46 contacts with a front end of the rear end wall portion 35*a* of the first outer wall 35, thereby the rear end of the horizontal portion of the L-shaped bent piece 46 being held in position. Consequently, the horizontal portion of the L-shaped bent piece 46 is arranged as a member that partitions between the coil spring accommodating space and the swinging space.

The coupling portion 33 of the ejection member 30 couples between a forward end portion of the body 31 and the card push portion 34. The coupling portion 33 includes the vertical outer wall 33*a*, a horizontal lower wall 33*b*, and a vertical inner wall 33*c* and is substantially U-shaped as viewed from the front, or in vertical section. The vertical outer wall 33*a* extends to the first inner wall 37 from the forward end of the horizontal upper wall 32 of the body 31 and is bent vertically downward from the left side of the horizontal upper wall 32. The vertical outer wall 33*a* lies in the same plane as those of the first inner wall 37 and the second inner wall 38, so that the vertical outer wall 33*a* defines a part of the inner wall of the body 31 to form the coil spring accommodating space as described above.

The horizontal lower wall 33*b* is bent at a right angle to and leftward from a lower end of the vertical outer wall 33*a* and then the vertical inner wall 33*c* is bent at a right angle to and upward from a left end of the horizontal lower wall 33*b*. The horizontal lower wall 33*b* is substantially flat and formed so that its underside is arranged in contact with the upper surface of the right guide rail 25*b* when assembled. Also, the vertical outer wall 33*a* and the vertical inner wall 33*c* are in parallel to each other. As shown in FIG. 10, a left, forward portion of the horizontal lower wall 33*b* is formed as a portion including a step 33*d* and projecting forward from the body 31 of the ejection member 30 and coupled to the card push portion 34 via the vertical inner wall 33*c*. Accordingly, a forward end surface 34*b* of the card push portion 34 is positioned forwardly of the forward end portion of the body 31 as shown in FIG. 10.

The card push portion 34 of the ejection member 30 is a flat member as a whole and is bent at a right angle to and leftward from an upper end of the vertical inner wall 33*c* of the coupling portion 33 to extend a predetermined length toward the left. The card push portion 34 is also formed so that its upper surface is disposed in a lower position than a horizontal plane of the horizontal upper wall 32 of the body 31 of the ejection member 30. In addition, a left end 34*c* of the card push portion 34 is preferably bent downward or obliquely downward from the flat card push portion 34.

The horizontal lower wall 33*b* and the vertical inner wall 33*c* of the coupling portion 33 and the card push portion 34 extend in the card accommodating space 5. A right half of the rear end surface of the card push portion 34, against which a tip end surface 94 of the IC card 90 abuts, is formed as an inclined surface 34*a* corresponding to a notch 93 formed on the IC card 90. The inclined surface 34*a* is contiguous to an inclined surface 33*e* of the horizontal lower wall 33*b* of the coupling portion 33. The inclined surface 34*a* is provided to prevent reverse insertion (both sides or fore-and-aft) of the IC card 90 and is a conventionally known structure. Also, a left half of the rear end surface of the card push portion 34 is in parallel to the tip end surface 94 of the IC card 90 inserted, so perpendicular to a direction, in which the IC card 90 is inserted and drawn, and further at a right angle to the right guide rail 25*b*, which guides the IC card 90. The forward end surface 34*b* of the card push portion 34 is in parallel to the left half of the rear end surface of the card push portion 34, and so perpendicular to the direction, in which the IC card 90 is inserted and withdrawn, further also in parallel to the front wall 22 of the base member 20.

The coil spring 40, which constitutes a push-push type ejection mechanism, is held between the first coil spring support piece 17 of the cover member 10 described above and the second coil spring supporting piece 47 of the ejection member 30 to expand and contract as the ejection member 30 moves. As described above, the coil spring 40 is also accommodated in the coil spring accommodating space defined by the horizontal upper wall 32 of the body 31, the first outer wall 35, the vertical outer wall 33*a* of the coupling portion 33, and the first inner wall 37 of the ejection member 30. Accordingly, when the IC card 90 is mounted to the card connector 1 and the coil spring 40 is fully compressed, the greater part of the coil spring 40 is accommodated in the coil spring accommodating space whereby the coil spring 40 is prevented from flexing in a left and right direction. Thereby, the lock pin 44 is positioned on an extension of a center line extending in a longitudinal direction of the coil spring 40 to bias the ejection member 30 rearwardly straight without inclination.

Also, as the IC card 90 is inserted and the coil spring 40 is compressed, the coil spring 40 is supported to flex to become upwardly or downwardly convex in the coil spring accommodating space. For example, the first coil spring support piece 17, which is provided on the roof plate 11 to support one end of the coil spring 40, and the second coil spring supporting piece 47, which is provided on the ejection member 30 to support other end of the coil spring 40, are preferably formed so that tip ends thereof are inclined to be directed a little upward or downward. With such construction, when the coil spring 40 is compressed, the coil spring 40 flexes to be upwardly or downwardly convex, so that the coil spring 40 abuts against the horizontal upper wall 32 of the ejection member 30, which defines the coil spring accommodating space. Thereby, the ejection member 30 can move so that the horizontal upper wall 32 thereof contacts with the roof plate 11 of the cover member 10. Consequently, for example, the horizontal lower wall 33*b* constituting the ejection member 30 can avoid moving in contact with the upper surface of the right guide rail 25*b* of the base member 20 as far as possible, so that the ejection member 30 can prevent abrasion of the base member 20. In addition, the coil spring 40 may be supported in a preloaded state when the IC card 90 is not inserted, or the tip end surface 94 of the IC card 90 does not abut against the card push portion 34 of the ejection member 30. In this case, a distance between the first coil spring support piece 17 and the second coil spring supporting piece 47 is made small so that the coil spring 40 is supported to flex to become upwardly or downwardly convex.

While the construction of the card connector 1 according to the invention has been described, motions of mounting the IC card 90 into or taking out the same from the card connector 1 (or motions of inserting and withdrawing the IC card) will be briefly described with reference to FIGS. 3 and 4 although such motions are not specifically different from conventional ones.

FIG. 3 shows a state, in which the IC card 90 is inserted through the card insertion port 6 into the card accommodating space 5 and the tip end of the IC card 90 reaches the rear end surface of the card push portion 34 of the ejection member 30, which includes the inclined surface 34*a*. At this time, as shown in FIG. 3, all members, which include the ejection member 30 and constitute a push-push type ejection mechanism, are disposed in original positions. Specifically, the coil spring 40 is put in a state of being not compressed, therefore, not loaded and expanded. Also, a rear end of the ejection member 30 (more specifically, the body 31) contacts with the inner surface of the abutment wall 27 of the base member 20 and the lock pin 44 of the swinging arm 41 is positioned in a predetermined position (starting point) in the cam groove 29*b*, distant from the heart cam 29*a*, which constitutes the heart cam mechanism 29. Also, the engagement projection 42*a* of the feeling lock member 42 engages with the engagement recess 91 of the IC card 90.

When the IC card 90 is inserted further forward from the state of FIG. 3, the tip end of the IC card 90 pushes the card push portion 34 of the ejection member 30 whereby the ejection member 30 also moves forward. The ejection member 30 moves forward in a state, in which the first outer wall 35 and the second outer wall 36 of the body 31 contact with the right wall 12*b* of the cover member 10, and also in a state, in which respective lower ends of the first inner wall 37 and the second inner wall 38 are loosely fitted into the rail groove 26. As the ejection member 30 moves forward, the coil spring 40 is compressed and the lock pin 44 moves in the cam groove 29*b*, which constitutes the heart cam mechanism 29. Accordingly, a predetermined pushing force opposing the spring force of the coil spring 40 is needed for insertion of the IC card 90 in this stage.

As shown in FIG. 4, the forward end surface 34*b* of the card push portion 34 of the ejection member 30 reaches the front wall 22 of the base member 20 whereby insertion of the IC card 90 is stopped. After the insertion is stopped, when the pushing force for insertion of the IC card 90 is released, the IC card 90 is returned rearward by the bias of the coil spring 40. At this time, the lock pin 44 is guided to the cam groove 29*b* formed around the heart cam 29*a*, which constitutes the heart cam mechanism 29, and conducted to a recessed portion of the heart cam to obstruct the retreat of the ejection member 30. Accordingly, the IC card 90 is held in a mounted state shown in FIG. 4. Also, the card recognition switch 60 detects mounting of the IC card 90 and the write-protect switch 70 detects a position of the write-protect button 92 to determine whether writing into the IC card 90 should be inhibited or not.

In the mounted state shown in FIG. 4, when the IC card 90 is to be taken out or withdrawn from the card connector 1, the IC card 90 is pushed forward against the spring force of the coil spring 40 until the IC card 90 reaches the front wall 22 and stops. Thereby, the ejection member 30 moves forward in the same manner as when the IC card 90 is inserted. At this time, the lock pin 44 is guided to the cam groove 29*b* formed around the heart cam 29*a*, which constitutes the heart cam mechanism 29, and comes off the recessed portion of the heart cam 29*a* to enable the ejection member 30 to retreat. At this time, when the pushing force for the IC card 90 is released, the ejection member 30 is retreated by the bias of the coil spring 40 to return to an original position shown in FIG. 3. At this time, since the engagement projection 42*a* of the feeling lock member 42 engages with the engagement recess 91 of the IC card 90, the IC card 90 stops in a position shown in FIG. 3 without jumping out rearward from the accommodating space of the card connector 1 due to the inertia. After the IC card 90 stops, that portion of the IC card 90, which projects from the card connector 1, is picked by fingers and the IC card 90 is withdrawn whereby it is completed to take the IC card 90 out of the card connector 1.

Second Embodiment

Figure 12:
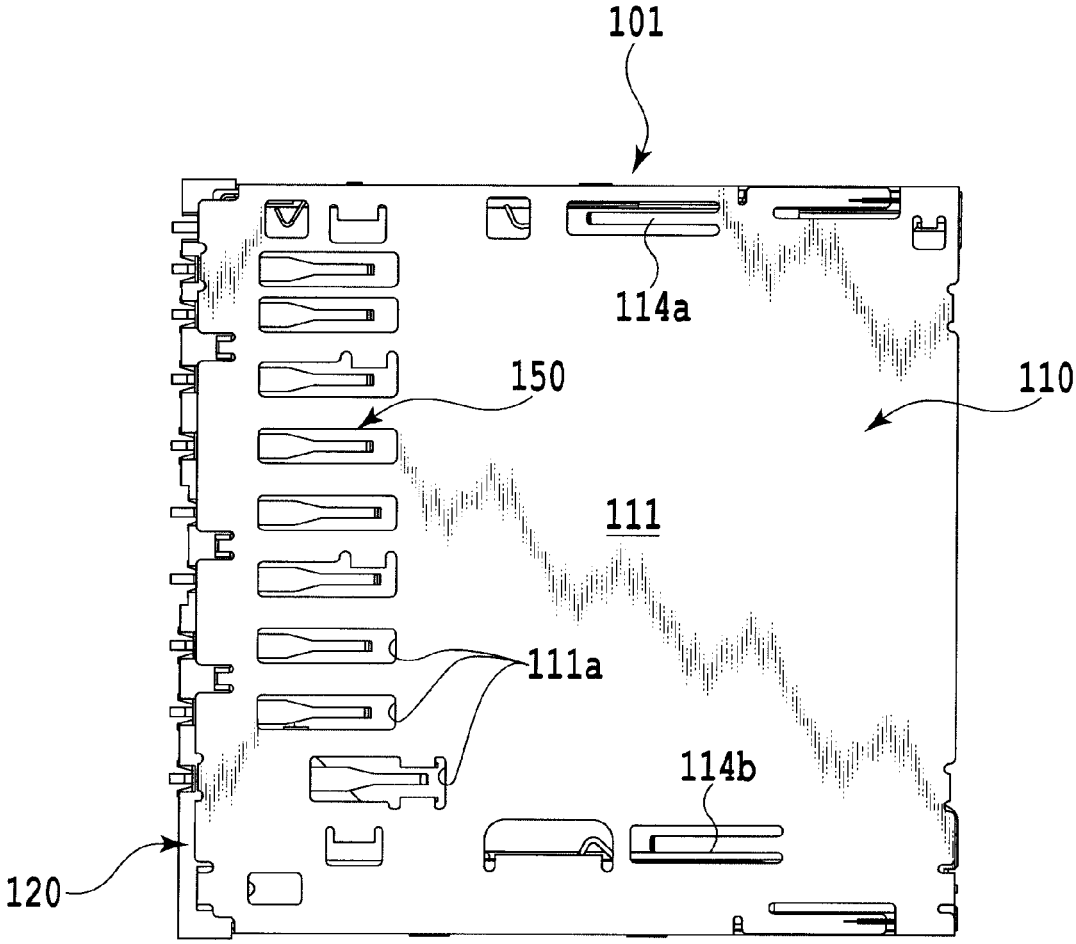
FIG. 12 is a bottom view showing a card connector according to a second embodiment of the invention.
Figure 13:
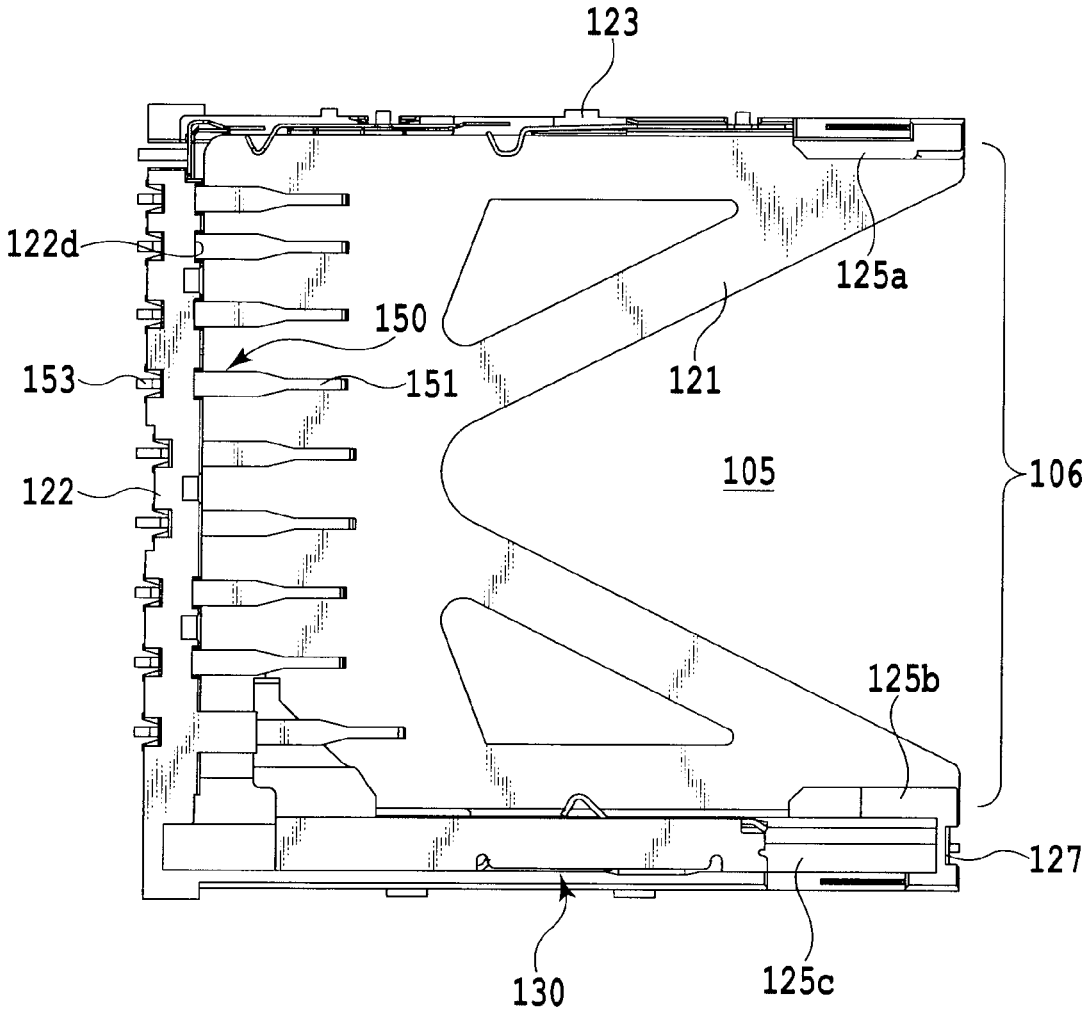
FIG. 13 is a bottom view showing the card connector of FIG. 12 with a cover member removed.
Figure 14:
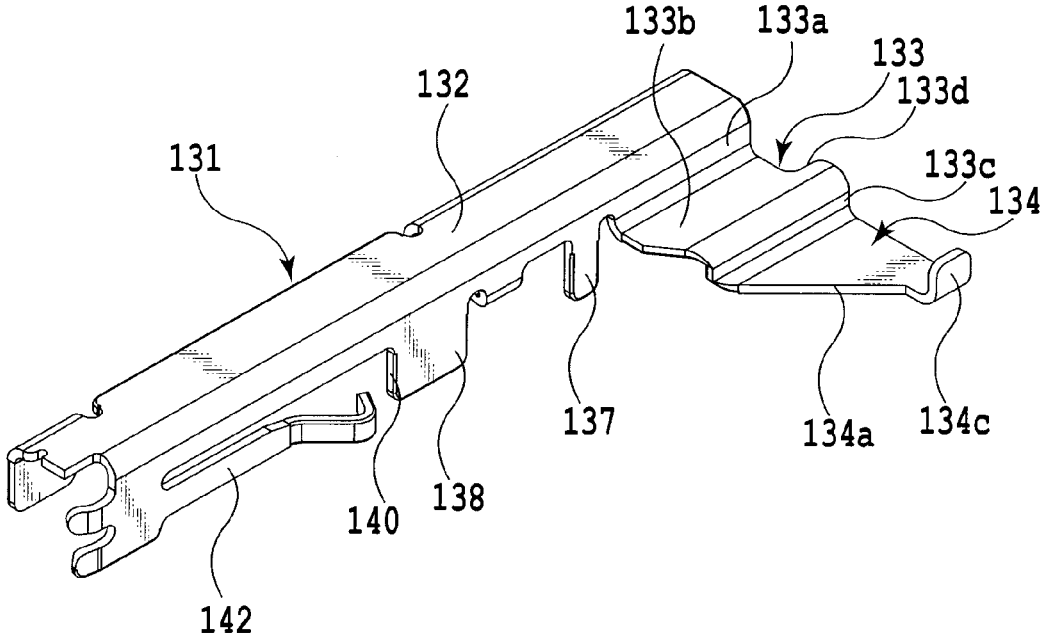
FIG. 14 is a perspective view showing an ejection member used in the card connector, according to the second embodiment, shown in FIG. 12, as viewed from leftwardly, obliquely rearwardly and underneath.
Figure 15:
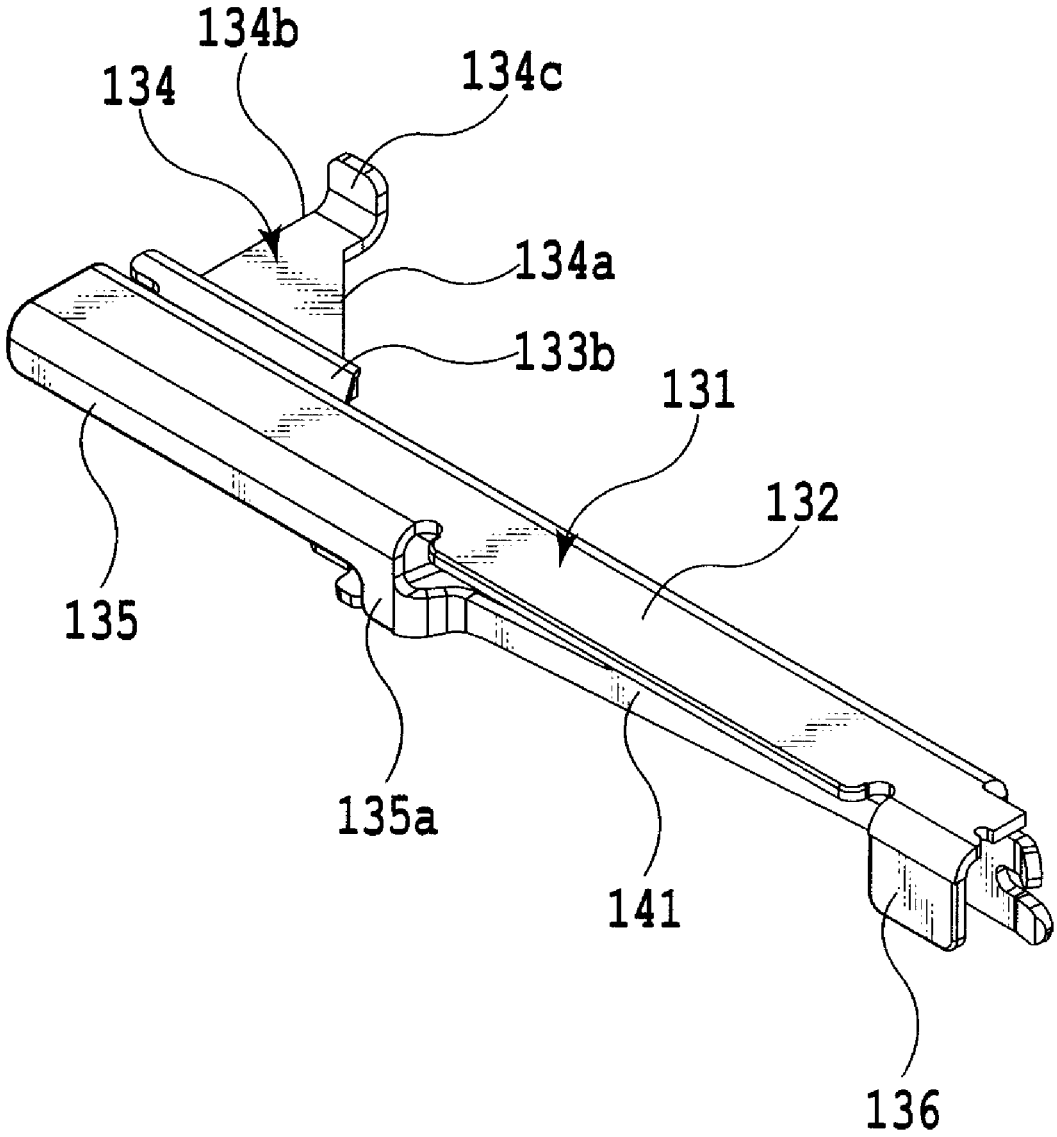
FIG. 15 is a perspective view showing the ejection member shown in FIG. 14, as viewed from rightwardly, obliquely rearwardly and underneath.
Figure 16:
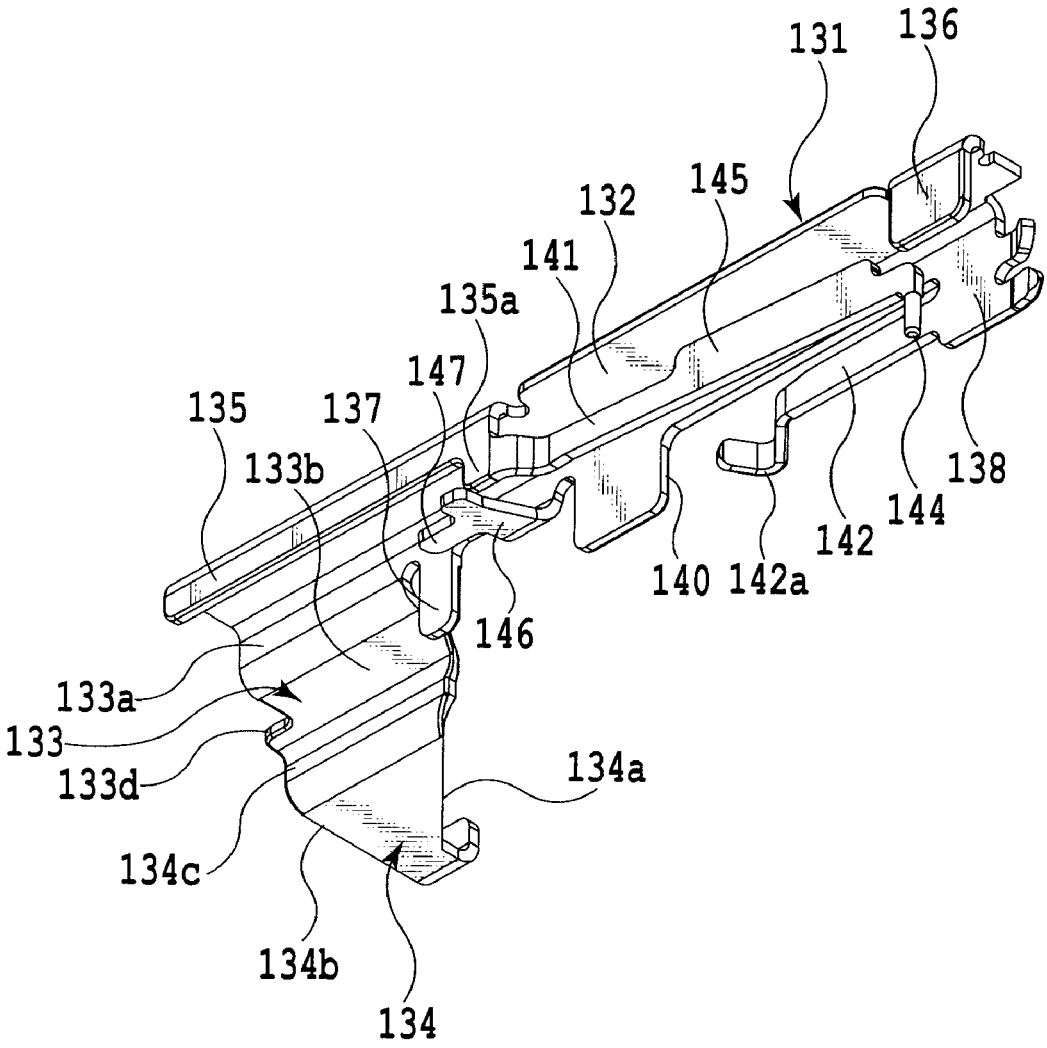
FIG. 16 is a perspective view showing the ejection member shown in FIG. 14, as viewed from rightwardly, obliquely rearwardly and above.
Figure 17:
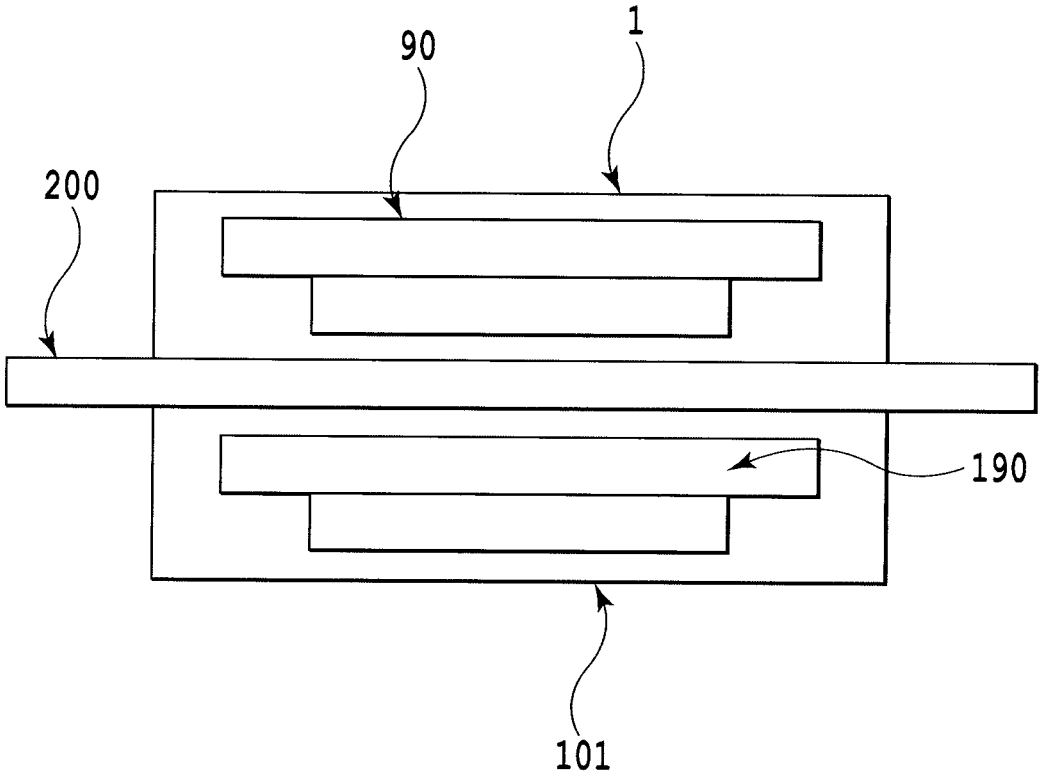
FIG. 17 is a conceptual view showing a state, in which the card connector according to the first embodiment and the second embodiment is applied to a circuit board.

Subsequently, a second embodiment of the invention will be described with reference to FIGS. 12 to 17. FIG. 12 is a bottom view showing a card connector according to the second embodiment of the invention, and FIG. 13 is a bottom view showing the card connector of FIG. 12 with a cover member removed. FIG. 14 is a perspective view showing an ejection member used in the card connector, according to the second embodiment, shown in FIG. 12, as viewed from leftwardly, obliquely rearwardly and under. FIG. 15 is a perspective view showing the ejection member shown in FIG. 14, as viewed from rightwardly, obliquely rearwardly and under, and FIG. 16 is a perspective view showing the ejection member shown in FIG. 14, as viewed from rightwardly, obliquely rearwardly and above. FIG. 17 is a conceptual view showing a state, in which the card connector according to the first embodiment and the second embodiment is applied to a circuit board. In addition, the drawings of FIGS. 12 to 16 are ones as viewed from under and it should be taken into consideration that in actual use shown in FIG. 17, parts or constituent elements shown in FIGS. 12 to 16 are arranged while turning upside down. Also, in the second embodiment shown in FIGS. 12 to 17, in case of indicating the same parts or constituent elements as those illustrated in the first embodiment, they are denoted by numerals with 100 added to the numerals indicated in the first embodiment.

As shown in the conceptual view of FIG. 17, it is determined in some cases whether a card connector is arranged on an upper side or a lower side of a circuit board 200 according to the arrangement of other parts being mounted on an electronic equipment. In such cases, from the point of view related to insertion of an IC card, it is preferred that a similar IC card be mounted to a card connector arranged on a lower side in the same posture as that of an IC card mounted to the card connector arranged on an upper side. A card connector 101 according to the embodiment is used as a card connector arranged on the lower side of the circuit board 200. That is, the card connector 101 according to the embodiment is constructed so that an IC card 190 being mounted can be mounted in the same posture as that of the IC card 90 mounted to a card connector arranged on an upper side, for example, the card connector 1 according to the first embodiment. In addition, in the embodiment, the IC card 190 mounted to the card connector 101 is also not limitative but is a same SD card as the first embodiment.

As shown in FIGS. 12, 13, and 17, the card connector 101 in the embodiment substantially comprises a cover member 110, a base member 120, an ejection member 130, and a plurality of contacts 150 in the same manner as the card connector 1 according to the first embodiment. As understood from FIG. 17, the card connector 101 has a construction, in which the base member 120 is arranged in an upper portion thereof, the cover member 110 is arranged in a lower portion thereof, and is arranged while turning upside down relative to the card connector 1 of the first embodiment. However, the IC card 190 is inserted and taken out from the card connector 101 in the same posture as that of the IC card 90 in the card connector 1 of the first embodiment. That is, the IC card 190 is mounted to the card connector 101, which is formed from the base member 120 on the upper side and the cover member 110 on the lower side, in such posture that a portion of the IC card 190 being large in width is disposed on the upper side and a portion being small in width with a step therebetween is disposed on the lower side.

The cover member 110 in the embodiment is formed from a metallic sheet by means of press working and has substantially the same structure as that in the first embodiment. The cover member 110 in the embodiment is different from the cover member 10 of the first embodiment in that as understood from FIG. 17, the cover member 110 in the embodiment is caused to overlap the base member 120 from under to thereby define a card accommodating space 105, in which the IC card 190 is accommodated. In addition, as described above, it is required that the IC card 190 be mounted to the card connector 101, arranged on the lower side of the circuit board 200, in the same posture as that of the IC card 90 mounted to the card connector 1 on the upper side of the circuit board 200. That is, as described above, the IC card 190 is mounted to the card connector 101, which is formed from the base member 120 on the upper side and the cover member 110 on the lower side, in a posture, in which a portion of the IC card 190 being large in width is disposed on the upper side and a portion being small in width with a step therebetween is disposed on the lower side. In order to enable the IC card 190 to be mounted in this manner, contact portions 151 of a plurality of contacts 150 are held on a front wall 122 of the base member 120 in a cantilever-like manner so as to be displaced downward. With such construction, it is necessary to enable making the contact portions 151 of the contacts 150 large in downward displacement magnitude and to prevent short circuit among the contacts 150 due to such displacement of the contact portions 151. Therefore, in the embodiment, unlike the first embodiment, a plurality of slits 111*a* are preferably formed on a roof plate 111 of the cover member 110, which is arranged below the plurality of contacts 150, to correspond to the plurality of contacts 150.

The base member 120 in the embodiment fundamentarily has substantially the same structure as that of the base member 20 in the first embodiment. That is, the base member 120 is formed from an insulating, synthetic resin to be substantially shaped like a box and includes a bottom wall 121, the front wall 122, a left wall 123, a pair of left and right guide rails 125*a*, 125*b*, and a guide bottom wall 125*c*. Also, like the first embodiment, the base member 120 is caused to overlap the cover member 110 to define a card accommodating space 105, in which at least a part of the IC card 190 can be accommodated. In addition, as understood from FIG. 17, the base member 120 is mounted to the lower side of the circuit board 200 so that the bottom wall 121 is positioned above. However, like the first embodiment, the IC card 190 is inserted forward from a card insertion port 106 formed rearwardly of the card accommodating space 105 in the same posture as that of the IC card 90 in the first embodiment.

With respect to the base member 120, the present embodiment is considerably different from the first embodiment in a construction, in which a plurality of contacts 150 are held. As shown in FIG. 12. the plurality of contacts 150 are press fitted into through-holes 122*d*, which are formed on a lower portion of the front wall 122 of the base member 120 to extend through the front wall 122 in a longitudinal direction, and held in a cantilever-like manner. That is, the plurality of contacts 150 are held on the front wall 122 so that a tip end portion of the IC card 190 mounted enters between the bottom wall 121 and the plurality of contacts 150. Also, the pair of left and right guide rails 125*a*, 125*b* for guiding of left and right steps of the IC card 190 inserted are formed to project toward an interior of the card accommodating space 105 from an abutment wall 127 formed at rear ends of the left wall 123 and the guide bottom wall 125*c* of the base member 120. The pair of left and right guide rails 125*a*, 125*b* extend longitudinally. The pair of left and right guide rails 125*a*, 125*b* are also formed below the base member 120 in the same manner as the contacts 150.

Subsequently, the ejection member 130 according to the second embodiment will be described with reference to FIGS. 14 to 16. The ejection member 130 according to the embodiment is a main member constituting a push-push type ejection mechanism and is formed from a metallic sheet by means of press working in the same manner as in the first embodiment. The structure of the ejection member 130 in the present embodiment is substantially the same as that of the ejection member 30 in the first embodiment. The ejection member 130 according to the embodiment will be briefly described below as well as a difference made by the fact that the ejection member 130 of the embodiment is arranged substantially symmetrically to the ejection member 30 of the first embodiment with the circuit board 200 therebetween (with respect to portions as omitted, see the first embodiment).

In the present embodiment, the ejection member 130 comprises a body 131 being substantially U-shaped as viewed from the front, a coupling portion 133 being substantially step-shaped as viewed from the front, and a card push portion 134.

The body 131 substantially includes a horizontal lower wall 132, a first outer wall 135 and a second outer wall 136, which serve as an outer wall (right wall), and a first inner wall 137 and a second inner wall 138, which serve as an inner wall (left wall), and is substantially U-shaped as viewed from the front, or in vertical section.

The horizontal lower wall 132 is substantially flat and extends a predetermined length in a longitudinal direction to contact with the roof plate 111 of the cover member 110 when assembled. A substantially forward half of the horizontal lower wall 132 cooperates with the first outer wall 135, a vertical outer wall 133*a* of the coupling portion 133, and the first inner wall 137 to define a coil spring accommodating space that accommodates a coil spring (not shown). Also, a substantially rearward half of the horizontal lower wall 132 cooperates with the second outer wall 136 and the second inner wall 138 to define a swinging space of a swinging arm 141. Accordingly, also in the embodiment, the coil spring accommodating space and the swinging space are arranged in a row in a longitudinal direction (that is, on the same line in a longitudinal direction) whereby it is possible to make the connector small in widthwise dimension.

Also, in the present embodiment, when assembled, the first outer wall 135 and the second outer wall 136 of the ejection member 130 contact with a right wall of the cover member 110 to be movable in a longitudinal direction.

In the present embodiment, the swinging arm 141 is formed between the first outer wall 135 and the second outer wall 136. The swinging arm 141 is worked using an outer wall portion, which lies between the first outer wall 135 and the second outer wall 136, in the same manner as in the first embodiment. The swinging arm 141 can swing in the swinging space with a rear end of a rear end wall portion 135*a* as a supporting point, and a lock pin 144 is formed at a tip end of the swinging arm 141 to be directed upward. Further, a holding projection 145 is formed on the swinging arm 141 to project downward in a reverse direction to a direction, in which the lock pin 144 projects. In the present embodiment, the holding projection 145 is formed to extend longitudinally along the swinging arm 141. By forming the holding projection 145 in this manner, the swinging arm 141 is reinforced.

The first inner wall 137 and the second inner wall 138 are bent from the horizontal lower wall 132 to make a right angle to the lower wall 132. The second inner wall 138 is positioned rearwardly of and on an extension of the first inner wall 137. The second inner wall 138 extends to a position of approximately a half of the length of the horizontal lower wall 132 from a rear end of the horizontal lower wall 132. Upper end portions of the first inner wall 137 and the second inner wall 138 are loosely fitted into a rail groove (not shown) formed on the guide bottom wall 125*c* of the base member 120 to be able to move longitudinally in the rail groove.

The second inner wall 138 is formed with a longitudinally elongated rectangular-shaped notch 140, and using and working an inner wall portion lying in the notch 140, a feeling lock member 142 is formed to extend longitudinally in the notch 140 from an upper end of a rear end side of the notch 140. Unlike the first embodiment, the feeling lock member 142 is formed at an upper end of the notch 140 to correspond to an upper wide portion of the IC card 190 mounted. The feeling lock member 142 is supported on the second inner wall 138 at the upper end of the rear end side of the notch 140 in a cantilever-like manner. The feeling lock member 142 comprises an engagement projection 142*a* formed to project into the card accommodating space, and the engagement projection 142*a* engages with an engagement recess (not shown) formed on the upper wide portion of the IC card 190 when the IC card 190 abuts against the card push portion 134. The feeling lock member 142 is capable of elastic deformation with the upper end of the rear end side of the notch 140 as a supporting point. The feeling lock member 142 prevents the IC card 190 mounted from coming off and prevents the IC card 190 from vigorously jumping out of the card accommodating space when the IC card 190 is to be removed.

Also, in the present embodiment, a second coil spring supporting piece 147 is provided between the first inner wall 137 and the second inner wall 138 to support the other end of a coil spring (not shown), which biases the ejection member 130 rearward. The second coil spring supporting piece 147 is formed to project forward, for example, horizontally from an intermediate portion of a forward end of a L-shaped bent piece 146.

The coupling portion 133 of the ejection member 130 couples a forward end portion of the body 131 with the card push portion 134. The coupling portion 133 includes the vertical outer wall 133*a*, a horizontal wall 133*b*, and a vertical inner wall 133*c* and is step-shaped as viewed from the front, or in vertical section. The ejection member 130 of the embodiment is structurally different in the cross sectional shape of the coupling portion 133 from the ejection member 30 of the first embodiment. Owing to such structure, the card push portion 134 of the ejection member 130 is arranged to correspond to the upper wide portion of the IC card 190 mounted. The vertical outer wall 133*a* extends to the first inner wall 137 from the forward end of the horizontal lower wall 132 of the body 131 and is bent vertically upward from the left side of the horizontal lower wall 132. The vertical outer wall 133*a* lies in the same plane as those of the first inner wall 137 and the second inner wall 138, so that the vertical outer wall 133*a* defines a part of the inner wall of the body 131 to form the coil spring accommodating space as described above.

The horizontal wall 133*b* is bent at a right angle to and leftward from an upper end of the vertical outer wall 133*a* and then the vertical inner wall 133*c* is bent at a right angle to and upward from a left end of the horizontal wall 133*b*. The horizontal wall 133*b* is substantially flat and formed so that its upper surface is arranged in contact with the upper surface of the right guide rail 125*b* when assembled. Also, the vertical outer wall 133*a* and the vertical inner wall 133*c* are in parallel to each other. As shown in FIGS. 13 and 15, a left, forward portion of the horizontal wall 133*b* is formed as a portion including a step 133*d* and projecting forward from the body 131 of the ejection member 130 and coupled to the card push portion 134 through the vertical inner wall 133*c*. Accordingly, a forward end surface 134*b* of the card push portion 134 is positioned forwardly of the forward end of the body 131 as shown in FIGS. 13 and 15.

The card push portion 134 of the ejection member 130 comprises a flat member as a whole and is bent at a right angle to and leftward from an upper end of the vertical inner wall 133*c* of the coupling portion 133 to extend a predetermined length toward the left. The card push portion 134 is also formed so that an upper surface thereof does not contact with the bottom wall 121 of the base member 120 when assembled as the card connector 101. In addition, a left end 134*c* of the card push portion 134 is preferably bent downward or obliquely downward from the flat card push portion 134.

The horizontal wall 133*b* and the vertical, inner wall 133*c* of the coupling portion 133 and the card push portion 134 extend in the card accommodating space 105. A right half of that rear end surface of the card push portion 134, against which a tip end surface of the IC card 190 abuts, is formed as an inclined surface 134*a* corresponding to a notch (not shown) formed on the IC card 190.

In addition, motions of mounting the IC card 190 in or taking the same out of the card connector 101 (or motions of inserting and withdrawing an IC card) are the same as that described in the first embodiment, and so an explanation therefor is omitted.

While the present invention has been discussed with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A card connector, in which a card accommodating space capable of accommodating at least a part of a card with an integrated circuit built therein in an insertable and drawable manner is formed by assembling a base member formed from an insulating, synthetic resin and having at least a bottom wall and a front wall and a cover member formed from a metallic sheet and having at least a roof plate and right and left side walls, the card connector comprising a plurality of contacts arranged on the base member and connected electrically to the card, an ejection member capable of moving in a longitudinal direction, in which the card is inserted and withdrawn, relative to the base member as the card is inserted and withdrawn, and having a swinging arm capable of elastic deformation in a right and left direction, a compression coil spring that biases the ejection member rearward when the card is mounted in the card accommodating space, and a heart cam mechanism including a heart cam formed on the base member and a cam groove formed to extend around the heart cam and from the heart cam and permitting movement therein of a lock pin provided at a tip end of the swinging arm, and wherein the ejection member includes a card push portion, against which a tip end of the card abuts, a body, on a forward portion of which a coil spring accommodating space accommodating therein the compression coil spring is formed, on a rear portion of which a swinging space enabling the swinging arm to swing right and left therein is formed, and which is U-shaped in vertical section, and a coupling portion, which couples between the card push portion and the forward portion of the body, the ejection member including the card push portion, the body, and the coupling portion is formed integrally from a metallic sheet, and the coil spring accommodating space and the swinging space are arranged in a row on the same line in a longitudinal direction.

2. The card connector as claimed in claim 1, wherein the ejection member further includes a feeling lock member capable of elastic deformation in a right and left direction, and the feeling lock member is provided in a position opposed to the swinging arm within the swinging space and a supporting point of the feeling lock member and a supporting point of the swinging arm are positioned diagonally within the swinging space.

3. The card connector as claimed in claim 2, wherein the body, which constitutes the ejection member, includes a horizontal wall, an outer wall, and an inner wall and is U-shaped in vertical section, and the coupling portion, which constitutes the ejection member, includes a horizontal wall, a vertical outer wall, and a vertical inner wall, the vertical outer wall of the coupling portion constituting a part of the inner wall of the body.

4. The card connector as claimed in claim 3, wherein the swinging arm is formed from a part of the outer wall of the body, which constitutes the ejection member, and formed to swing right and left in the swinging space, and the feeling lock member is formed from a part of the inner wall of the body, which constitutes the ejection member, and formed to swing right and left between the card accommodating space and the swinging space.

5. The card connector as claimed in claim 4, wherein the horizontal wall of the body, which constitutes the ejection member, moves in a longitudinal direction to contact with the roof plate of the cover member.

6. The card connector as claimed in claim 3, wherein the coupling portion is formed by the horizontal wall, the vertical outer wall, and the vertical inner wall to be U-shaped in vertical section.

7. The card connector as claimed in claim 3, wherein the coupling portion is formed by the horizontal wall, the vertical outer wall, and the vertical inner wall to be step-shaped in vertical section.

* * * * *